US005547796A

United States Patent [19]

Kohtaki et al.

[11] Patent Number: 5,547,796

[45] Date of Patent: Aug. 20, 1996

[54] DEVELOPER CONTAINING INSULATING MAGNETIC TONER FLOWABILITY-IMPROVING AGENT AND INORGANIC FINE POWDER

[75] Inventors: Takaaki Kohtaki, Yokohama; Masaaki Taya; Masami Fujimoto, both of Kawasaki, all of Japan

[73] Assignee: Canon Kabushiki Kaisha, Tokyo, Japan

[21] Appl. No.: 276,509

[22] Filed: Jul. 18, 1994

Related U.S. Application Data

[63] Continuation-in-part of Ser. No. 67,283, May 26, 1993, abandoned.

[30] Foreign Application Priority Data

May 27, 1992 [JP] Japan ..... 4-158952
Apr. 28, 1993 [JP] Japan ..... 5-123151

[51] Int. Cl.[6] ..... G03G 9/083; G03G 9/107; G03G 9/10; G03G 9/00

[52] U.S. Cl. ..... 430/106.6; 430/105; 430/107; 430/109; 430/110; 430/903

[58] Field of Search ..... 430/105, 106.6, 430/107, 109, 110, 903

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,504,563 | 3/1985 | Tanaka et al. | 430/107 |
| 4,837,100 | 6/1989 | Murofushi et al. | 430/106.6 |
| 4,933,252 | 6/1990 | Nishikawa et al. | 430/109 |
| 4,957,840 | 9/1990 | Sakashita et al. | 430/109 |
| 5,041,351 | 8/1991 | Kitamori et al. | 430/106.6 |
| 5,110,977 | 5/1992 | Wilson et al. | 430/105 |
| 5,137,796 | 8/1992 | Takiguchi et al. | 430/106.6 |
| 5,164,774 | 11/1992 | Tomita et al. | 430/109 |
| 5,169,738 | 12/1992 | Tanikawa et al. | 430/106.6 |
| 5,348,829 | 9/1994 | Uchiyama et al. | 430/106.6 |

FOREIGN PATENT DOCUMENTS

| | | | |
|---|---|---|---|
| 55-134861 | 10/1980 | Japan | G03G 9/08 |
| 58-66951 | 4/1983 | Japan | G03G 9/08 |
| 59-139053 | 8/1984 | Japan | G03G 9/08 |
| 59-168458 | 9/1984 | Japan | G03G 9/08 |
| 59-168459 | 9/1984 | Japan | G03G 9/08 |
| 59-168460 | 9/1984 | Japan | G03G 9/08 |
| 59-170847 | 9/1984 | Japan | G03G 9/08 |
| 60-32060 | 2/1985 | Japan | G03G 9/08 |
| 61-123856 | 6/1986 | Japan | G03G 9/08 |
| 61-123857 | 6/1986 | Japan | G03G 9/08 |
| 61-183664 | 8/1986 | Japan | G03G 9/08 |
| 61-236559 | 10/1986 | Japan | G03G 9/08 |
| 62-280758 | 12/1987 | Japan | G03G 9/08 |
| 63-2073 | 1/1988 | Japan | G03G 9/08 |
| 1-112255 | 4/1989 | Japan | G03G 9/08 |
| 2-110475 | 4/1990 | Japan | G03G 9/087 |

*Primary Examiner*—George F. Lesmes
*Assistant Examiner*—Bernard P. Codd
*Attorney, Agent, or Firm*—Fitzpatrick, Cella, Harper & Scinto

[57] ABSTRACT

A developer for developing an electrostatic image is constituted by an insulating magnetic toner, inorganic fine powder and a flowability-improving agent having a BET specific surface area of at least 30 $m^2/g$. The insulating magnetic toner has a weight-average particle size ($t\text{-}D_4$) of 4–14 μm, a number-average particle size ($t\text{-}D_1$) of 1–10 μm, and a ratio ($t\text{-}D_4$)/($t\text{-}D_1$) of 1.01–2. The inorganic fine powder has a weight-average particle size ($m\text{-}D_4$) of 0.6–5 μm, a number-average particle size ($m\text{-}D_1$) of 0.5–4 μm, and a ratio ($m\text{-}D_4$)/($m\text{-}D_1$) which is in the range of 1.0–2.4 and is equal to or larger than the ratio ($t\text{-}D_4$)/($t\text{-}D_1$). The inorganic fine powder is contained in an amount which is 2–8 times that of the flowability-improving agent by weight. The developer is able to retain stable developing performances by effecting suppressing preferential consumption of a particular particle size fraction in a long term of successive copying.

22 Claims, 5 Drawing Sheets

VOLUME-BASIS DISTRIBUTION

NUMBER-BASIS DISTRIBUTION

DEVELOPER CONTAINING INSULATING MAGNETIC TONER FLOWABILITY-IMPROVING AGENT AND INORGANIC FINE POWDER

This application is a continuation-in-part of application Ser. No. 08/067,283, filed May 26, 1993, now abandoned.

FIELD OF THE INVENTION AND RELATED ART

The present invention relates to a developer for developing electrostatic images in image forming methods, such as electrophotography, electrostatic recording and electrostatic printing.

Hitherto, a large number of electrophotographic processes have been known, as disclosed in U.S. Pat. Nos. 2,297,691; 3,666,363; 4,071,361 and others. In these processes, an electric latent image is formed on a photosensitive member comprising a photoconductive material by various means, then the latent image is developed and visualized with a toner, and the resultant toner image is, after transferred onto paper, etc., as desired, fixed by heating, pressing, heating and pressing, etc.

As for the step of fixing the toner image onto a sheet material such as paper which is the final step in the above process, various methods and apparatus have been developed, of which the most popular one is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation, so that the method is very effective in a high-speed electrophotographic copying machine.

In order to improve the fixability in such a fixing system, it has been proposed to use a binder resin containing an acidic component in Japanese Laid-Open Patent Application (JP-A) 55-134861. However, a toner using such a binder resin is liable to cause an insufficient charge in a high-humidity environment and an excessive charge in a low-humidity environment, thus being liable to be affected by changes in environmental conditions. Further, the toner is liable to cause fog and provide images having low densities.

On the other hand, an acid anhydride component in a binder resin functions to provide a toner with an enhanced chargeability, and some examples of using resins containing an acid anhydride have been proposed in JP-A 59-139053 and JP-A 62-280758. In these publications, there are disclosed methods wherein a polymer containing acid anhydride units at a high density is diluted with a binder resin. In these methods, such an acid anhydride-containing resin is required to be uniformly dispersed in the binder resin, otherwise the resultant toner particles are liable to be ununiformly charged, thus resulting in fog and adversely affecting the developing characteristic.

Accordingly, in order to solve the problem of poor dispersibility, it is more effective to disperse acid anhydride units by copolymerization as a part of polymer chains for the dilution so as to provide toner particles with a uniform chargeability as proposed in, e.g., JP-A 61-123856 and JP-A 61-123857. The thus-proposed toners are provided with good fixability, anti-offset characteristic and developing performance.

However, these toners can be excessively charged to result in fog or density decrease in some cases when applied to a high-speed copying machine in a low humidity environment.

Further, accompanying development of digital copying machines and reduction in size of toner particles in recent years, it has been desired to develop copying machines having multiplicity of functions and capable of providing high-quality copy images.

As for the diversification in function of the copying machines, for example, a part of an image is erased, e.g., by exposure and another image is inserted therein to effect superposed multi-color copying, or a marginal frame part on copying paper is erased into white. In such cases, such a white-erased part is liable to be fog, when an excessively charged toner is used.

More specifically, when an image is erased by imparting a potential of a polarity opposite to a latent image potential with respect to a developing basis potential by illumination with strong light from an LED or a fuse lamp, the liability of fog at the part is enhanced.

Thus, the development of digital system and a toner of a smaller particle size may provide improvements in resolution and clarity of images, but can also result in various problems accompanying it.

A first problem is the occurrence of the above-mentioned fog. A smaller toner particle size leads to an increase in surface area of toner particles per unit weight, thus tending to result in a broader charge distribution of the toner and increased fog. Accompanying the increase in surface area of the toner particles, the toner chargeability is more liable to be affected by the environment.

Further, a smaller toner particle size also tends to increase the influence of the dispersion state of a polar substance and a colorant on the toner chargeability.

A recent digital copying machine is even required to provide a combination of a character image which is clear and a photographic image which faithfully reproduces the density gradation of the original. As a general tendency in a copy of a photographic image with characters, an increase in line image density for proving clearer characters not only impairs the density gradation characteristic of the photographic image but results in remarkable roughness in the halftone portion.

In recent years, it has become possible to provide an image with improved density gradation by reading the image density at respective portions of an image and digitally converting the read density data, but a further improvement is desired at present.

Such further improvements largely depend on improvements in developing characteristics of a developer. Image densities do not usually satisfy a linear relationship with developing potentials (differences between potentials of a photosensitive member and a developer-carrying member) but show a tendency of projecting downwardly at low developing potentials and projecting upwardly at higher developing potentials as indicated by a solid curve in FIG. 2. Accordingly, in a halftone region, the image density varies greatly corresponding to a slight change in developing potential. As a result, it is difficult to provide a density gradation characteristic which is fully satisfactory.

In order to obtain a clear copy of a line image, it is practically sufficient to have a maximum density on the order of 1.30 at a solid image part not readily affected by an edge effect as the contrast of a line image is generally enhanced by the edge effect.

In a photographic image, however, an original image has a very large maximum density of 1.90–2.00 while the impression thereof is largely affected by a surface gloss. Accordingly, in a copy of such a photographic image having a generally large area and not causing a density increase owing to the edge effect, it is necessary to retain a maximum image density of about 1.4–1.5 at a solid image part even if the surface gloss is suppressed.

Accordingly, in copying a photographic image with characters, it is very important to satisfy a linear relationship between the developing potential and the image density and retain a maximum image density of 1.4–1.5.

For the above purpose, it is critical to control the toner chargeability as uniformly as possible.

As methods of preventing the excessive toner charge and stabilizing the toner charge by using electroconductive powder, JP-A 58-66951, JP-A 59-168458 to JP-A 59-168460 and JP-A 59-170847 have proposed the use of electroconductive zinc oxide and tin oxide. According to these methods, the maximum density is generally on the order of 1.3 and, in case where much electroconductive powder is used, a maximum density of 1.4 or above is obtained but the density gradation characteristic becomes inferior. A larger toner chargeability tends to provide a broader distribution of toner charge. The above methods intend to provide a narrower charge distribution by attaching the electroconductive powder to a toner having a large chargeability to lower the chargeability. Even by these methods, however, it is difficult to obtain a fully satisfactory copy of a photographic image with characters.

JP-A 61-183664 has disclosed a method wherein a non-magnetic toner having a volume-average particle size of 5–20 μm is blended with fine powder having a volume-average particle size which is 1/20–1/2 times that of the toner to stabilize the replenishing characteristic of the toner and form a thin and uniform layer of the toner, thus providing a sufficient charge. According to this method, it is possible to stabilize the toner replenishing, form a thin layer of developer on a developer-carrying member and increase the toner charge with respect to a color toner, but it is difficult to provide a sharp charge distribution or a copy image having a maximum density of 1.4–1.5 and a sufficient gradation.

JP-A 60-32060 has proposed a method wherein two kinds of inorganic fine powder are used to remove paper dust and ozone adduct formed on or attached to the surface of a photosensitive member.

JP-A 2-110475 has proposed a method wherein two kinds of inorganic fine powder are used in combination with a toner comprising styrene-acrylic resin crosslinked with a metal to remove paper dust and ozone adduct formed on or attached to a photosensitive member, improve the toner fixability, and alleviate toner scattering, image flow and image density decrease in a high temperature—high humidity environment.

According to these methods, it is surely possible to remove substances attached to a photosensitive member, but the above-mentioned various problems have not been solved satisfactorily.

JP-A 61-236559 and JP-A 63-2073 have disclosed methods wherein cerium oxide particles are used to disintegrate agglomerated silica and toner, thereby increasing the toner chargeability. According to this method, the toner chargeability can be surely increased but, when an organic photosensitive member is used, the surface layer of the photosensitive member can be gradually abraded due to a large abrasive effect of the cerium oxide, so that the performances of the photosensitive member can be lowered to gradually provide copy images of inferior quality in some cases.

JP-A 1-112255 has disclosed a method wherein organic fine particles and two or more kinds of inorganic fine powder are used. This method is characterized by the use of two or more kinds of inorganic fine particles and organic fine particles having an average primary particle size which is at most 3 μm and is larger than the average primary particle size of the inorganic fine powder. Even by this method, however, the above-mentioned problems have not been solved satisfactorily.

Accordingly, a developer satisfactorily solving the above-mentioned various problems is still desired.

SUMMARY OF THE INVENTION

An object of the present invention is to provide a developer for developing electrostatic images which has solved the above-mentioned problems and can be used in an image forming method using an organic photosensitive member.

Another object of the present invention is to provide a developer for developing electrostatic images capable of providing copy images free from fog and having a high density without impairing the fixability.

Another object of the present invention is to provide a developer for developing electrostatic images capable of providing good images under low humidity and high humidity conditions respectively without being affected by a change in environmental conditions.

Another object of the present invention is to provide a developer for developing electrostatic images which can stably provide good images even in a high-speed machine and is thus applicable to a wide variety of types of copying machines.

Another object of the present invention is to provide a developer for developing electrostatic images which is excellent in successive copying characteristic and can provide copy images having a high image density and free from fog on a white background even in a long period of continuous use.

A further object of the present invention is to provide a developer for developing electrostatic images which is excellent in resolution and thin-line reproducibility and can provide a copy of a photographic image with characters including clear characters and a photographic image showing a density gradation faithful to the original.

A still further object of the present invention is to provide a developer for developing electrostatic images including a magnetic toner, whereby the magnetic toner can be uniformly applied on a developer-carrying member and the magnetic toner can be uniformly and stably charged without excess or shortage, simultaneously, for a long period of time, so that the magnetic toner is caused to jump more effectively.

According to the present invention, there is provided a developer for developing an electrostatic image, comprising:

an insulating magnetic toner having a weight-average particle size ($t\text{-}D_4$) of 4–12 μm, a number-average particle size ($t\text{-}D_1$) of 1–10 μm, and a ratio $(t\text{-}D_4)/(t\text{-}D_1)$ of 1.01–2, a flowability-improving agent having a BET specific surface area of at least 30 $m^2/g$, and inorganic fine powder having a weight-average particle size ($m\text{-}D_4$) of 0.6–5 μm, a number-average particle size $(m\text{-}D_1)$ of 0.5–4 μm, and a ratio $(m\text{-}D_4)/(m\text{-}D_1)$ which is in the range of 1.1–2.4 and is equal to or larger than the ratio $(t\text{-}D_4)/(t\text{-}D_1)$, wherein the inorganic fine powder is contained in an amount which is 2–8 times that of the flowability-improving agent by weight.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
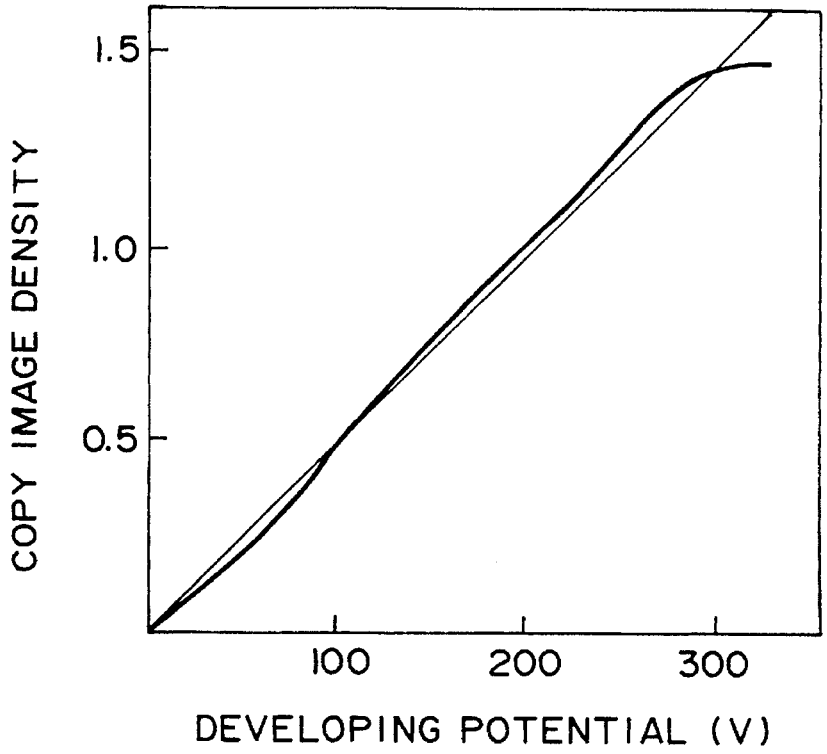
FIG. 1 is a graph showing a relationship between copy image density and developing potential obtained by using a developer according to the present invention.
Figure 2:
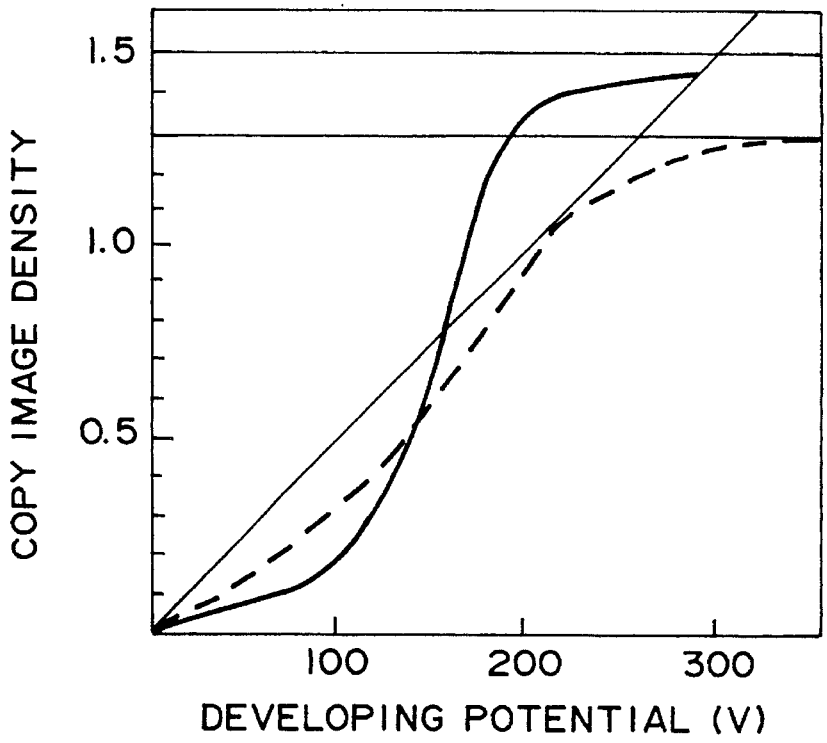
FIG. 2 is a graph showing relationship between copy image density and developing potential obtained by using a developer outside the present invention, wherein a solid curve represents a case wherein the maximum image density is set to 1.4 or higher, and a dashed line represents a case wherein a condition is set to provide a good density gradation.

The charge distribution of a one-component type magnetic toner is affected by the dispersion state of materials (e.g., a magnetic material, a colorant, etc.) constituting the toner and the toner particle size distribution. In case where the toner-constituting materials are uniformly dispersed, the charge distribution is principally affected by the toner particle size distribution. A small-particle size toner generally has a large charge, and a large particle size toner generally has a small charge. A toner having a larger charge generally has a broader charge distribution, and vice versa.

In order to provide a toner having a large charge with a narrower charge distribution, there is known a method of attaching electroconductive powder to the toner to lower the charge. According to this method, a good density gradation characteristic is obtained but a sufficiently high maximum image density is not obtained. We have considered the reason as follows.

In the method of attaching electroconductive powder to a toner to lower the charge, electroconductive powder may not be attached to the toner particles uniformly because the electroconductive powder itself is charged though it is slight, but the powder is preferentially attached to smaller toner particles according to electrostatic force.

In triboelectrification through friction between toner particles, the surface of toner particles contacting each other is charged, so that the same toner particles have positive and negative charges. Accordingly, as smaller toner particles have a larger surface area per unit weight, the electroconductive powder is considered to be preferentially attached to smaller toner particles regardless of its charge polarity. As smaller toner particles having a larger surface area have a larger charge per unit weight, they cause white background fog when they are charged in a reverse polarity. Accordingly, if electroconductive powder is blended with a toner and attached to small toner particles, the fog can be alleviated.

However, small toner particles to which electroconductive powder having a large effect of lowering the toner charge is attached are preferentially consumed for development. Accordingly, the density gradation characteristic is improved. However, such small toner particles can cover only a smaller area of a recording material, such as paper, by melting and enlargement during the fixation than larger toner particles so that the maximum image density obtained thereby is somewhat lower than that obtained by larger toner particles.

Further, small toner particles are preferentially consumed for development, so that the half-tone image quality is good at the initial stage but becomes inferior, as represented by roughening, due to the increase in toner particle size in the developer container.

As a result of energetic study, we have found a method of increasing the charge of a toner fraction having a lower charge in the charge distribution by contact of the toner with inorganic fine powder such as that of metal oxides contrary with reduction of the charge of a toner as in the former method. The inorganic fine powder is not intended to be attached to toner particles but is caused to triboelectrically charge toner particles in a developer container so as to obtain uniformly charged toner particles.

Very small inorganic fine powder relative to a certain particle size of toner shows a very strong image force on toner particles so that the inorganic fine powder remains attached to the toner particles even if it receives a shearing force by stirring and rotation of a developer-carrying member within a developer container. As a result, such very small inorganic fine powder shows an effect of decreasing the toner charge as in the above method. However, inorganic fine powder having a substantial particle size relative to a certain particle size of toner frequently repeats attachment to the toner and separation from the toner due to a shearing force within the developer container, thus reversely increasing the charge of a rather large toner fraction.

As a result of further study based on the above concept, we have found the following.

Inorganic fine powder is effective in providing a uniform charge if the inorganic fine powder has a particle size distribution width or factor $[(m\text{-}D_4)/(m\text{-}D_1)]$ which is equal to or larger than a particle size distribution width or factor $[(t\text{-}D_4)/(t\text{-}D_1)]$ of the toner. This is because inorganic fine powder in a certain particle size range has an ability of remarkably increasing the charge of a toner fraction having a certain particle size. Accordingly, the particle size distribution of the inorganic fine powder is preferably broader than that of the toner.

Further, it has been found important that the developer satisfies the following conditions.

(1) The toner has a weight-average particle size of 4–12 μm, a number-average particle size of 1–10 μm, and a distribution width $[(t\text{-}D_4)/(t\text{-}D_1)]$ of 1.01–2.

(2) A flowability-improving agent having a BET specific surface area of at least 30 $m^2/g$ is used.

(3) The inorganic fine powder has a weight-average particle size of 0.6–5 μm, a number-average particle size of 0.5–4 μm and a distribution width $[(m\text{-}D_4)/m\text{-}D_1)]$ of 1.1–2.4.

The above conditions are important respectively for the following reasons.

(1) If the weight-average particle size of the toner exceeds 12 μm, the half-tone image is roughened. If below 4 μ, the white background fog becomes worse.

Toner particles having a size of above 12 μm require inorganic fine powder having a large particle size, which is not consumed for development and accumulated in the vicinity of the developer-carrying member. Accordingly, the inorganic fine powder having a large particle size are present in a large amount on the developer-carrying member and the amount of the toner used for development is decreased, thus resulting in difficulties, such as white streaks in an image, a decrease in image density and roughening of halftone images.

Toner particles having a size of below 4 μm may be provided with an increased charge by using inorganic fine powder having a small particle size if the particle size alone is considered. However, such small toner particles have an increased surface area, so that the uniform charge of the toner cannot be retained unless a large amount of the inorganic fine powder is used. If a large amount of inorganic fine powder having a small particle size is used, a cleaning failure can be caused due to passing through a cleaning blade, or the inorganic fine powder gradually abrades the surface resin layer of an organic photosensitive member to deteriorate the sensitivity of the photosensitive member and causes a deterioration of copy image quality, such as an image density decrease.

If the toner particle size distribution width $[(t\text{-}D_4)/(t\text{-}D_1)]$ exceeds 2, the charge distribution is also broadened, so that a sufficiently uniform charge cannot be obtained even if the inorganic fine powder according to the present invention is used.

(2) If a flowability-improving agent is not used, the one-component magnetic toner is provided with a remarkably inferior flowability, thus causing a charging failure. Further, if no flowability-improving agent is used, the flowability of the waste toner at the cleaning part is impaired and the surface resin layer of the photosensitive member is abraded or damaged to result in deteriorated images.

(3) Inorganic fine powder having a weight-average particle size exceeding 5 μm increases the toner charge to some extent but is not consumed for development onto a white reversal part, thus being accumulated in the developing device to increase the amount thereof on the developer-carrying member. As a result, the copy image quality is gradually impaired. Inorganic fine powder having a weight-average particle size of 0.6 μm tends to lower the toner charge as described above, thus being unsuitable for the present invention. If the $[(m\text{-}D_4)/(m\text{-}D_1)]$ ratio exceeds 2.4, excessively small particles and excessively large particles are contained in large amounts because of a broad particle size distribution, thus being unsuitable.

If the $[(m\text{-}D_4)/(m\text{-}D_1)]$ ratio is below 1.1, the inorganic fine powder is caused to have a low triboelectric charge-imparting ability to the toner particles. It is further preferred that the $[(m\text{-}D_4)/(m\text{-}D_1)]$ ratio is in the range of 1.2–1.8.

In the developer of the present invention, it is preferred that the inorganic fine powder is not substantially charged or is charged to a polarity opposite to that of the toner. In the present invention, the increase in toner charge is intended by triboelectrification between the toner and inorganic fine powder, so that the use of inorganic fine powder having the same charge polarity not only lower the toner charge but also causes a decrease in triboelectrification speed, thus leading to a so-called rising phenomenon that the copy image density is low at the initial stage but is gradually increased on continuation of the copying.

Further, if inorganic fine powder having a charge polarity reverse to the toner is used, small toner particles and small particles of the inorganic fine powder cause mutual interaction. That is, two types of small particles each having a large charge and a large interacting surface area per unit weight cause mutual interaction because of their reverse charge polarities. Further, large toner particles and large particles of inorganic fine powder cause mutual interaction. In the developer vessel, a combination of two types of smaller particles is less affected by triboelectrification due to stirring than a combination of two types of larger particles. This is because, when subjected to a shearing force by stirring, the smaller particles tend to pass without receiving the shearing force. Small particles of the inorganic fine powder imparts a small charge to small toner particles because the total charge of the small inorganic fine powder particles is small. On the other hand, in the case of a combination of larger inorganic fine powder particles and large toner particles, the triboelectric charge is largely affected by the stirring and the total charge of the inorganic fine powder particles is also large, so that large toner particles which basically has a small charge per unit weight is provided with an increased charge. As a result, the difference in developing power depending on the toner particle size is decreased and the possibility of preferential consumption for developing of a particular particle size toner is decreased.

As has been discussed above, while the particle sizes of the toner and the inorganic fine powder are important, the relationship between the particle size distribution widths or factors of the toner and the inorganic fine powder and the relationship between the toner particle size and the inorganic fine powder particle size are very important in view of charging mechanism due to the mutual interaction.

The inorganic fine powder may preferably have a charging polarity opposite to that of the insulating magnetic toner and may preferably have a triboelectric charge of 1–20 $\mu c/cm^3$, more preferably 2–15 $\mu c/cm^3$, further preferably 3–9 $\mu c/cm^3$, respectively, in terms of an absolute value.

As a result of detailed study regarding the above described points, it has been found further effective to satisfy the following relationships:

$1.0 \leqq$ [weight-average particle size of inorganic fine powder/number-average particle size of inorganic fine powder] /[weight-average particle size of magnetic toner/number-average particle size of magnetic toner] $\leqq 2.3$, $1.5 \leqq$ [weight-average particle size of magnetic toner $(t\text{-}D_4)$]/[weight-average particle size of inorganic fine powder $(m\text{-}D_4)$] $\leqq 7.0$.

If the developer satisfies the above conditions, the above-mentioned various problems can be solved in a further satisfactory manner. In the developer according to the present invention, the above-mentioned phenomenon that only small particle size toner is preferentially consumed for development. As a result, even on continuation of the copying, the roughening of halftone images is not caused and it is possible to obtain toner images which are excellent in thin-line reproducibility and are fully satisfactory in respects of density gradation characteristic and maximum image density.

It is further important that the inorganic fine powder is used in an amount which is 2–8 times that of the flowability-improving agent by weight so as to satisfactorily retain the developing performance of the developer and prevent the preferential consumption for development.

Further preferable features of the developer in order to accomplish the objects of the invention will be discussed hereinbelow.

It is preferred to mix organic fine powder which is charged to a polarity opposite to the toner and has a number-average particle size (p-$D_1$) is 0.8 μm or smaller. The organic fine powder is attached to the toner and prevents the excessive charge of the toner due to localized attachment of the flowability-improving agent, thus functioning to improve the uniform charging of the toner. Due to the presence of the organic fine powder, it is possible to control the height of ears of the developer on the developer-carrying member and alleviate the edge effect, thus minimizing the density change at the edge even in a solid image. As a result, it is possible to obtain a copy of a photographic image in a good image quality. Owing to the alleviation of the edge effect, it is possible to satisfactorily prevent a phenomenon that a portion of a large toner coverage is selectively prevented from being transferred to cause white dropout as encountered in a roller transfer apparatus used frequently in a printer, etc., in recent years. Further, in case where an organic photosensitive member is used, the abrasion thereof due to the toner or the inorganic fine powder is remarkably alleviated by the presence of the organic fine powder, so that the copy images retain good image quality stably for a long period. Due to the presence of the organic fine powder, it is also possible to satisfactorily present toner scattering. If the number-average particle size (p-$D_1$) of the organic fine powder exceeds 0.8 μm, the organic fine powder tends to be present in an isolated form without being attached to the toner, so that the uniform charging characteristic is impaired and the copy image quality tends to be gradually impaired on continuation of the copying.

The binder resin used in the present invention may for example include vinyl resins, polyester resins and epoxy resins. Among these, vinyl resins and polyester resins are preferred in view of chargeability and fixability.

More preferably in order to further improve not only the fixability but also the chargeability of the resultant toner, the vinyl monomer may preferably contain an acid anhydride group and have a total acid value (A) of 2–100 mgKOH/g, further preferably 5–70 mgKOH/g, still further preferably 5–50 mgKOH/g.

If the total acid value (A) is below 2 mgKOH/g, it is difficult to obtain good fixability. Above 100 mgKOH/g, it is difficult to control the chargeability of the toner.

The acid value may be imparted with acid groups, such as carboxyl group and acid anhydride group. These functional groups have a great influence on the toner chargeability. For example, the presence of carboxyl group has a weak ability of imparting negative charge. However, the presence of an increased amount of carboxyl group causes liberation of charge to moisture in the air. This tendency becomes noticeable as the content of carboxyl group increases.

On the other hand, acid anhydride group has a negative charge-imparting ability but its charge-liberating ability is negligible or extremely low.

Accordingly, for the stabilization of toner chargeability, the ratio of these functional groups is very important. More specifically, the carboxylic group functions to liberate the charge and also to impart the chargeability. On the other hand, the acid anhydride group functions effectively to only impart the chargeability. If excessive carboxyl group is present, the charge liberation is frequent to cause shortage of toner chargeability, so that it becomes difficult to obtain a sufficient image density. This tendency becomes noticeable in a high humidity environment.

On the other hand, in case where acid anhydride group is present in a large amount, the toner charge is liable to be excessive and cause an increased fog. This tendency in enhanced in a low humidity environment, thus being liable to cause a decrease in image density.

However, if these functional groups are present in appropriate proportions, it is possible to provide a good balance between charge imparting and charge liberation to stabilize the toner chargeability, thus minimizing the influence of the environmental change on the chargeability.

While imparting the chargeability by the presence of acid anhydride group, the excessive charge of the toner is prevented by effecting charge-liberation due to the presence of carboxyl group.

For the above purpose, it is important that the binder resin has a total acid value (B) attributable to acid anhydride group of at most 6 mgKOH/g. In excess of 6 mgKOH/g, the toner is liable to be excessively charged and can cause a density decrease or fog under a low humidity condition.

It is further preferred that the total acid value (B) attributable to acid anhydride group is at most 60% of the total acid value (A) of the overall binder resin. In excess of 60%, a balance between charge imparting and charge liberation is liable to be lost by dominance of charge-imparting ability, thus resulting in excessive charge of the toner.

The binder resin may be provided with an acid value by use of an acidic group-containing monomer, examples of which may include: unsaturated dibasic acids, such as maleic acid, citraconic acid, iraconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; half esters of unsaturated dibasic acids, such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, and monomethyl mesaconate; and unsaturated dibasic acid esters, such as dimethyl maleate and dimethyl fumarate. Further, there may also be used: α,β-unsaturated acids, such as acrylic acid, methacrylic acid, crotonic acid, and cinnamic acid; α,β-unsaturated acid anhydrides, such as crotonic anhydride and cinnamic anhydride; anhydrides between such α,β-unsaturated acids and lower fatty acids; alkenylmalonic acid, alkenylglutaric acid, and alkenyladipic acid.

Among the above, it is particularly preferred to use monoesters of α,β-unsaturated dibasic acids, such as maleic acid, fumaric acid and succinic acid as a monomer for providing the binder resin used in the present invention.

Examples of vinyl monomers to be used for providing a vinyl copolymer constituting the binder resin of the present invention may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the abovementioned α,β-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

The binder resin used in the present invention may include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

In the present invention, it is possible to mix one or more of homopolymers or copolymers of vinyl monomers as described above, polyester, polyurethane, epoxy resin, polyvinyl butyral, rosin, modified rosin, terpene resin, phenolic resin, aliphatic or alicyclic hydrocarbon resin, aromatic petroleum resin, etc., as desired, with the above-mentioned binder resin.

When two or more species of resins are mixed to provide a binder resin, it is preferred that the two or more species of resins have different molecular weights and are mixed in appropriate proportions.

The binder resin may preferably have a glass transition temperature of 45°–80° C., more preferably 55°–70° C., a number-average molecular weight (Mn) of 2,500–50,000, and a weight-average molecular weight of 10,000–1,000,000.

The vinyl type binder resin may be obtained through polymerization, such as bulk polymerization, solution polymerization, suspension polymerization, or emulsion polymerization. When a carboxylic acid monomer and/or an acid anhydride monomer is used, the bulk polymerization or solution polymerization may preferably be used in view of the monomer properties.

An exemplary method thereof is as follows. A vinyl copolymer may be obtained by using an acidic monomer, such as a dicarboxylic acid, a dicarboxylic anhydride or a dicarboxylic acid monoester through bulk polymerization or solution polymerization. In the solution polymerization, a part of the dicarboxylic acid and dicarboxylic acid monoester units may be converted into anhydrides by appropriately controlling the condition for distilling off the solvent. The vinyl copolymer obtained by the bulk polymerization or suspension polymerization may be further converted into anhydride units by heat-treating it. It is also possible to esterify a part of the acid anhydride unit with a compound, such as an alcohol.

Reversely, it is also possible to cause ring-opening of the acid anhydride units of the thus obtained vinyl copolymer to convert a part thereof into dicarboxylic units.

On the other hand, it is also possible to convert a vinyl copolymer obtained by using a dicarboxylic monoester monomer into anhydride by heat-treatment or into dicarboxylic acid by hydrolyzation. The vinyl copolymer obtained through bulk polymerization or solution polymerization may be further dissolved in a polymerizable monomer, followed by suspension polymerization or emulsion polymerization to obtain a vinyl polymer or copolymer, during which a part of the acid anhydride units can be subjected to ring-opening to be converted into dicarboxylic acid units. At the time of the polymerization, another resin can be mixed in the polymerizable monomer. The resultant resin can be subjected to conversion into acid anhydride by heat treatment, ring-opening of acid anhydride by treatment with a weak alkaline water, or esterification with an alcohol.

Dicarboxylic acid and dicarboxylic anhydride monomers have a strong tendency of alternate polymerization, a vinyl copolymer containing functional groups, such as acid anhydride and dicarboxylic acid units in a random dispersed state may be produced in the following manner as a preferable method. A vinyl copolymer is formed from a dicarboxylic acid monomer in solution polymerization, and the vinyl copolymer is dissolved in a monomer, followed by suspension polymerization to obtain a binder resin. In this process, all or a part of the dicarboxylic monoester units can be converted into anhydride units through de-alcoholic cyclization by controlling the condition for solvent removal after the solution polymerization. During the suspension polymerization, a part of the acid anhydride units may be hydrolyzed to cause ring-opening, thus providing dicarboxylic acid units.

The conversion into acid anhydride units in a polymer by a shift of infrared absorption of carbonyl toward a higher wave-number side than in the corresponding acid or ester. Thus, the formation or extinction of acid anhydride units may be conveniently confirmed by FT-IR (Fourier transform infrared spectroscopy).

The thus-obtained binder resin contains carboxyl group, acid anhydride group and dicarboxyl group uniformly dispersed therein, thus being able to provide a toner with satisfactory chargeability.

The polyester resin used in the present invention may preferably have a composition that it comprises 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

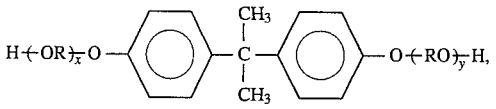

(A)

wherein R denotes an ethylene or propylene group, x and y are independently 0 or a positive integer with the proviso that the average of x+y is in the range of 0–10; diols represented by the following formula (B):

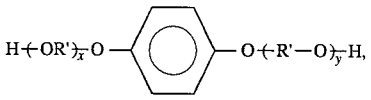

(B)

wherein R' denotes $-CH_2CH_2-$,

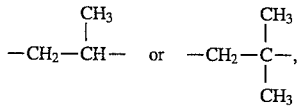

x' and y' are independently 0 or a positive integer with the proviso that the average of x'+y' is in the range of 0–10; and polyhydric alcohols, such as glycerin, sorbitol and sorbitan.

Examples of the dibasic acid constituting at least 50 mol. % of the total acid may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$-$C_{18}$ alkyl or alkenyl-substituted succinic acids, and their anhydrides; and unsaturated dicarboxylic acids, such as fumaric acid, maleic acid, citraconic acid and iraconic acid, and their anhydrides.

Examples of polybasic carboxylic acids having three or more functional groups may include: trimellitic acid, pyromellitic acid, benzophenonetetracarboxylic acid, and their anhydride.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride; and tricarboxylic acids such as trimellitic acid and its anhydride.

The polyester resins obtained from these acids and alcohols are preferred because they provide a toner for hot roller fixation showing good fixability and excellent anti-offset characteristic.

The polyester resin may preferably have an acid value of at most 90, more preferably at most 50, and an OH value of at most 50, more preferably at most 30. This is because the resultant toner is caused to have a chargeability remarkably affected by environmental conditions if the number of terminal groups is increased.

The polyester resin may preferably have a glass transition temperature of 50°–75° C., particularly 55°–65° C., a number-average molecular weight (Mn) of 1,500–50,000, particularly 2,000–20,000, and a weight-average molecular weight of 6,000–100,000, particularly 10,000–90,000.

The toner for developing electrostatic images according to the present invention can further contain a charge control agent, as desired, for further stabilizing the chargeability. The charge control agent may preferably be used in an amount of 0.1–10 wt. parts, particularly 0.1–5 wt. parts, per 100 wt. parts of the binder resin.

Charge control agents known in the art at present may include the following.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

Examples of the positive charge control agent for providing a positively chargeable toner may include: nigrosine, triphenylmethane compounds, rhodamine dyes, and polyvinylpyridine. It is also possible to use a binder resin showing a positive chargeability obtained from a monomer mixture containing 0.1–40 mol. %, preferably 1–30 mol. % of an amino-containing carboxylic acid ester, such as dimethylaminomethyl methacrylate. It is preferred to use colorless or pale-colored positive charge control agent not affecting the color tone of the resultant toner in some cases.

Examples of the positive charge control agent may include quarternary ammonium salts represented by the following structural formulae (A) and (B):

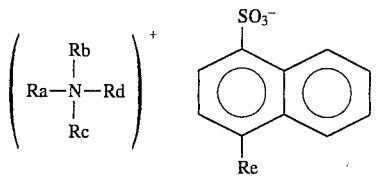

wherein Ra, Rb, Rc and Rd denote alkyl group having 1–10 carbon atoms or phenyl alkyl group represented by —R'— wherein R' denotes alkyl group having 1–5 carbon atoms; and Re denotes —H, —OH, —COOH or alkyl group having 1–5 carbon atoms.

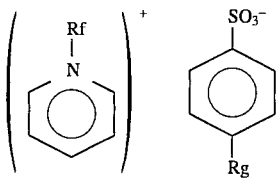

wherein Rf denotes alkyl group having 1–5 carbon atoms, and Rg denotes —H, —OH, —COOH or alkyl group having 1–5 carbon atoms.

Among the quarternary ammonium salts represented by the structural formulae (A) and (B), positive charge control agents represented by the following structural formulae (A)-1, (A)-2 and (B)-1 are preferred because they provide a good chargeability less affected by a change in environmental condition.

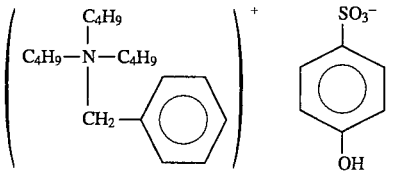

Formula (A)-1

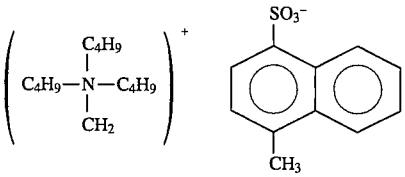

Formula (A)-2

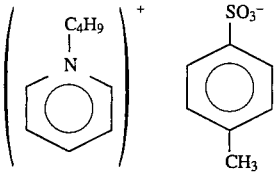

Formula (B)-1

In the case of using a binder resin showing a positive chargeability by inclusion of amino-containing carboxylic acid esters such as dimethylaminomethyl methacrylate for providing a positively chargeable toner, it is also possible to use a positive charge control agent or a negative charge control agent as desired.

In the case of using a binder resin not using an amino-containing carboxylic acid ester such as dimethylaminomethyl methacrylate providing a positive chargeability, it is preferred to use 0.1–15 wt. parts, preferably 0.5–10 wt. parts, of a positive charge control agent per 100 wt. parts of the binder resin. In the case of using a binder resin obtained by using an amino-containing carboxylic acid ester, a positive charge control agent and/or a negative charge control agent may be added, as desired, in an amount of 0–10 wt. parts, preferably 0–8 wt. parts, per 100 wt. parts of the binder resin for the purpose of providing a good chargeability less dependent on environmental conditions.

The insulating magnetic toner used in the present invention may preferably have a volume resistivity of at least $10^{14}$ ohm.cm.

Examples of the magnetic material contained in the insulating magnetic toner used in the present invention may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size of 0.1–2 μm, preferably 0.1–0.3 μm. The magnetic material may preferably show magnetic properties when measured by application of 10 kilo-Oersted, inclusive of: a coercive force of 20–150 Oersted, a saturation magnetization of 50–200 emu/g, particularly 50–100 emu/g, and a residual magnetization of 2–20 emu/g.

The magnetic material may be contained in the toner in a proportion of 10–200 wt. parts, preferably 20–150 wt. parts, per 100 wt. parts of the binder resin.

The toner according to the present invention may optionally contain a non-magnetic colorant, inclusive of arbitrary pigments or dyes.

Examples of the pigment may include: carbon black, aniline black, acetylene black, Naphthol Yellow, Hansa Yellow, Rhodamine Lake, Alizarine Lake, red iron oxide, Phthalocyanine Blue, and Indanthrene Blue. It is preferred to use 0.1–20 wt. parts, particularly 1–10 wt. parts, of a pigment per 100 wt. parts of the resin. For similar purpose, there may also be used dyes, such as azo dyes, anthraquinone dyes, xanthene dyes, and methine dyes, which may preferably be used in an amount of 0.1–20 wt. parts, particularly 0.3–10 wt. parts, per 100 wt. parts of the resin.

In the present invention, it is also possible to incorporate one or two or more species of release agent, as desired within, a toner.

Examples of the release agent may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, sasol wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, arachidic alcohol, behenyl alcohol, carnaubyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

The release agent may preferably be used in an amount of 0.1–20 wt. parts, particularly 0.5–10 wt. parts, per 100 wt. parts of the binder resin.

The release agent may be uniformly dispersed in the binder resin by a method of mixing the release agent in a solution of the resin at an elevated temperature under stirring or melt-kneading the binder resin together with the release agent.

The flowability-improving agent having a BET specific surface area of 30 $m^2/g$ functions to improve the flowability of the toner when added to the toner. Examples thereof may include: powder of fluorine-containing resin, such as polyvinylidene fluoride fine powder and polytetrafluoroethylene fine powder; titanium oxide fine powder, hydrophobic titanium oxide fine powder; fine powdery silica such as wet-process silica and dry-process silica, and treated silica obtained by surface-treating such fine powdery silica with silane coupling agent, titanium coupling agent, silicone oil, etc.

A preferred class of the flowability-improving agent includes dry process silica or fumed silica obtained by vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having a BET specific surface area of at least 30 $m^2/g$ and an average primary particle size of 0.001–2 μm, particularly 0.002–0.2 μm.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |

-continued

| |
|---|
| (Dow Corning Co.) |
| Fransol |
| (Fransil Co.) |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, etc., reactive with or physically adsorbed by the silica fine powder.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

The flowability-improving agent used in the present invention may have a specific surface area of at least 30 $m^2/g$, preferably 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner.

Positively chargeable inorganic fine powder usable in the present invention may, for example, comprise: oxides of metals, such as magnesium, zinc, aluminum, cobalt, copper, cerium, yttrium, manganese, bismuth, and strontium; complex metal oxides, such as calcium titanate, barium titanate, and strontium titanate; calcium titanate, barium sulfate.

Negatively chargeable inorganic fine powder usable in the present invention may, for example, comprise: oxides of metals, such as molybdenum, tungsten, tantalum, niobium, germanium, vanadium, silicon, titanium, tin, iron, chromium, and zirconium; silicides of metals, such as titanium, zirconium, niobium, tantalum, molybdenum, and tungsten; nitrides of metals, such as titanium, zirconium, vanadium, niobium and tantalum; and carbides of metals, such as titanium, zirconium, vanadium, niobium, tantalum, molybdenum, and tungsten.

Among the above, it is preferred to use oxides of metals, such as magnesium, zinc, aluminum, cobalt, iron, zirconium, manganese, chromium, and strontium; and complex metal oxides, such as calcium titanate, magnesium titanate, strontium titanate and barium titanate. It is further preferred to use zinc oxide, aluminum oxide, cobalt oxide, manganese dioxide, strontium titanate, or magnesium titanate so as to fully exhibit the effect of the present invention. It is particularly preferred to use powder of strontium titanate.

The inorganic fine powder, e.g., in the case of a metal oxide, may be produced by sintering, followed by mechanical pulverization and pneumatic classification to recover the powder with desired particle size and particle size distribution.

The inorganic fine powder may preferably be used in an amount of 0.01–20 wt. parts, particularly 0.1–10 wt. parts, per 100 wt. parts of the toner.

As described above, it is possible to add organic fine powder chargeable to a polarity opposite to that of the toner.

Negatively chargeable organic fine powder usable in the present invention may preferably comprise fine particles of a negatively chargeable resin, examples of which may include vinyl resins and polyester resins described above as toner binder resins, epoxy resin, phenolic resin, fluorine-containing resin and silicon resin.

In order to enhance the negative chargeability of the resin, it is also possible to use a negative charge control agent as used in a toner in an amount of preferably at most 20 wt. parts per 100 wt. parts of the negatively chargeable resin.

Positively chargeable organic fine powder usable in the present invention may preferably comprise fine particles of a positively chargeable resin, examples of which may include, polymethyl methacrylate resin, vinyl resins comprising partially or totally an amino group-containing monomer, such as dimethylaminoethyl methacrylate and p-dimethylaminostyrene, and polyamide resin.

Similarly as above, it is also possible to use a positive charge control agent as used in a toner for enhancing the positive chargeability. In the case of using such a positive charge control agent, it is also possible to use a vinyl resin obtained without using an amino group-containing monomer. The positive charge control agent may preferably be used in an amount of at most 20 wt. parts per 100 wt. parts of the resin.

The organic fine powder used in the present invention may be prepared in an appropriate particle size by emulsion polymerization, suspension polymerization or spray drying, or by pulverizing and classifying a resin obtained by polymerization, such as emulsion polymerization, solution polymerization or condensation polymerization.

The toner for developing electrostatic images used in the present invention may be produced by sufficiently mixing a binder resin, a magnetic material, and optional additives, such as a colorant, a charge control agent and others, by means of a mixer such as a Henschel mixer or a ball mill; then melting and kneading the mixture by hot kneading means such as hot rollers, kneader and extruder to disperse or dissolve the resin and others; cooling and pulverizing the mixture; and subjecting the pulverized product to classification to recover the toner of the present invention.

Further, the toner is sufficiently blended with a flowability-improving agent and inorganic fine powder such as metal oxide powder, by a mixer, such as a Henschel mixer to attach the additive to the toner particles, whereby a developer for developing electrostatic images according to the present invention is produced.

Various physical parameters characterizing the present invention may be measured according to the following methods.

(1) Particle size distribution

The particle size distribution of a powdery sample is measured by means of a Coulter counter in the present invention, while it may be measured in various manners.

Coulter counter Multisizer Type-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 μm by using the above-mentioned Coulter counter Multisizer Type-II with a 100 aperture for a toner sample or a 13 μm-aperture for an inorganic fine powder sample to obtain a volume-basis distribution and a number-basis distribution. From the results of the volume-basis distribution and number-basis distribution, parameters characterizing the toner or inorganic fine powder of the present invention may be obtained. More specifically, the weight-basis average particle size (t-$D_4$ or m-$D_4$) may be obtained from the volume-basis distribution while a central value in each channel is taken as a representative value for each channel.

Accordingly, the number-average particle size can be calculated from the formula of $\Sigma nD/\Sigma n$ (wherein D represents a central value of the particle diameter in each channel), and the weight-average particle size can be calculated from the formula of $\Sigma(nD^4)/\Sigma(nD^3)$ (wherein D represents a central value of the particle diameter in each channel.).

(2) Acid value of vinyl resin

Qualitative and quantitative analysis of functional groups may be performed, for example, by application of infrared absorption spectrum, acid value measurement according to JIS K-0070 and acid value measurement by hydrolysis (total acid value measurement).

For example, in the infrared (IR) absorption, the presence of an acid anhydride fraction can be confirmed by an absorption peak in the neighborhood of $1780^{-1}$ attributable to the carbonyl group in the acid anhydride.

Herein, the IR-absorption spectrum peak refers to a peak which is recognizable after 16 times of integration by FT-IR having a resolution of 4 $cm^{-1}$. A commercially available example of the FT-IR apparatus is "FT-IR 1600" (available from Perkin-Elmer Corp.).

The measurement of acid value according to JIS K-0070 (hereinafter referred to as "JIS acid value") provides an acid value of an acid anhydride which is about 50% of the theoretical value (based on an assumption that a mol of an acid anhydride provides an acid value identical to the corresponding dicarboxylic acid).

On the other hand, the total acid value (A) measurement provides an acid value which is almost identical to the theoretical value. Accordingly, the acid value attributable to an acid anhydride group per g of a resin can be obtained in the following manner:

$$\text{total acid value (B)}=[\text{total acid value (A)}-\text{JIS acid value}]\times 2.$$

For example, in the case of preparing a vinyl copolymer composition used as a binder resin by using maleic acid monoester as an acid component through solution polymerization and suspension polymerization, the total acid value (B) of a vinyl copolymer formed in the solution polymerization can be calculated by measuring the JIS acid value and the total acid value (A) of the vinyl copolymer, and the amount (e.g., in terms of mol. %) of the acid anhydride formed during the polymerization step and the solvent removal step can be calculated from the total acid value and the vinyl monomer composition used in the solution polymerization. Further, the vinyl copolymer prepared in the solution polymerization is dissolved in monomers, such as styrene and butyl acrylate to prepare a monomer composition, which is then subjected to suspension polymerization. In this instance, a part of the acid anhydride groups causes ring-opening. The contents of dicarboxylic acid group, acid anhydride group and dicarboxylic acid monoester group of the vinyl copolymer composition after the suspension polymerization used as the binder resin can be calculated from the JIS acid value, total acid value (A) of the vinyl copolymer composition obtained by the suspension polymerization, the monomer composition for the suspension polymerization and amount of the vinyl copolymer prepared in the solution polymerization.

The total acid value (A) of a binder resin used herein is measured in the following manner. A sample resin in an amount of 2 g is dissolved in 30 ml of dioxane, and 10 ml of pyridine, 20 mg of dimethylaminopyridine and 3.5 ml of water are added thereto, followed by 4 hours of heat refluxing. After cooling, the resultant solution is titrated with 1/10 N-KOH solution in THF (tetrahydrofuran) to neutrality with phenolphthalein as the indicator to measure the acid value, which is a total acid value (A). Under the condition for the measurement of the total acid value (A), an acid anhydride group is hydrolyzed into dicarboxylic acid groups, but an acrylic ester group, a methacrylic ester group or a dicarboxylic monoester group is not hydrolyzed.

The above-mentioned 1/10 N-KOH solution in THF is prepared as follows. First, 1.5 g of KOH is dissolved in about 3 ml of water, and 200 ml of THF and 30 ml of water are added thereto, followed by stirring. After standing, a uniform clear solution is formed, if necessary, by adding a small amount of methanol if the solution is separated or by adding a small amount of water if the solution is turbid. Then, the factor of the 1/10 N-KOH/THF solution thus obtained is standardized by a 1/10 N-HCl standard solution.

The binder resin may have a total acid value (A) of 2–100 mgKOH/g, but it is preferred that the vinyl copolymer containing an acid component in the binder resin has a JIS acid value of below 100. If the JIS acid value is 100 or higher, the functional group such as carboxyl group and acid anhydride group are contained at a high density, so that it becomes difficult to obtain a good balance of chargeability and the dispersibility thereof is liable to be problematic even when it is used in a diluted form.

(3) Acid value of polyester resin

2–10 g of a sample resin is weighed in a 200 to 300 ml-Erlenmeyer flask, and about 50 ml of a methanol/toluene (=30/70) mixture solvent is added thereto to dissolve the resin. In case of poor solubility, a small amount of acetone may be added. The solution is titrated with an N/10 KOH/alcohol solution standardized in advance with the use of a 0.1 % indicator mixture of bromothymol blue and phenolphthalein, The acid value is calculated from the consumption of the KOH/alcohol solution based on the following equation:

$$\text{Acid value}=\text{vol. (ml) of KOH/alcohol}\times N\times 56.1/\text{sample weight},$$

wherein N denotes the factor of the N/10 KOH/alcohol solution.

(4) Glass transition temperature Tg

Measurement may be performed in the following manner by using a differential scanning calorimeter (e.g., "DSC-7", available from Perkin-Elmer Corp.).

A sample in an amount of 5–20 mg, preferably about 10 mg, is accurately weighed.

The sample is placed on an aluminum pan and subjected to measurement in a temperature range of 30°–200° C. at a temperature-raising rate of 10° C./min in a normal temperature—normal humidity environment in parallel with a black aluminum pan as a reference.

In the course of temperature increase, a main absorption peak appears in the temperature region of 40°–100° C.

In this instance, the glass transition temperature is determined as a temperature of an intersection between a DSC curve and an intermediate line pressing between the base lines obtained before and after the appearance of the absorption peak.

(5) Molecular weight distribution

The molecular weight (distribution) of a binder resin may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 μl of a GPC sample solution adjusted at a concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of μ-styragel 500, $10^3$, $10^4$ and $10^5$ available from Waters Co; a combination of Shodex KF-801,802, 803, 804 and 805 available from Showa Denko K.K.; or a combinations of TSK gel G1000H, G2000H, G2500H, G3000H, G4000H, G5000H, G6000H, G7000H, and GMH available from Toso K.K.

(6) Average particle size of organic fine powder

The particle size or organic fine powder may be measured as a number-average particle size by observing at least 500 particles through an optical microscope equipped with a CCD camera at a magnification of 1000–4000.

(7) Triboelectric charge

Figure 6:
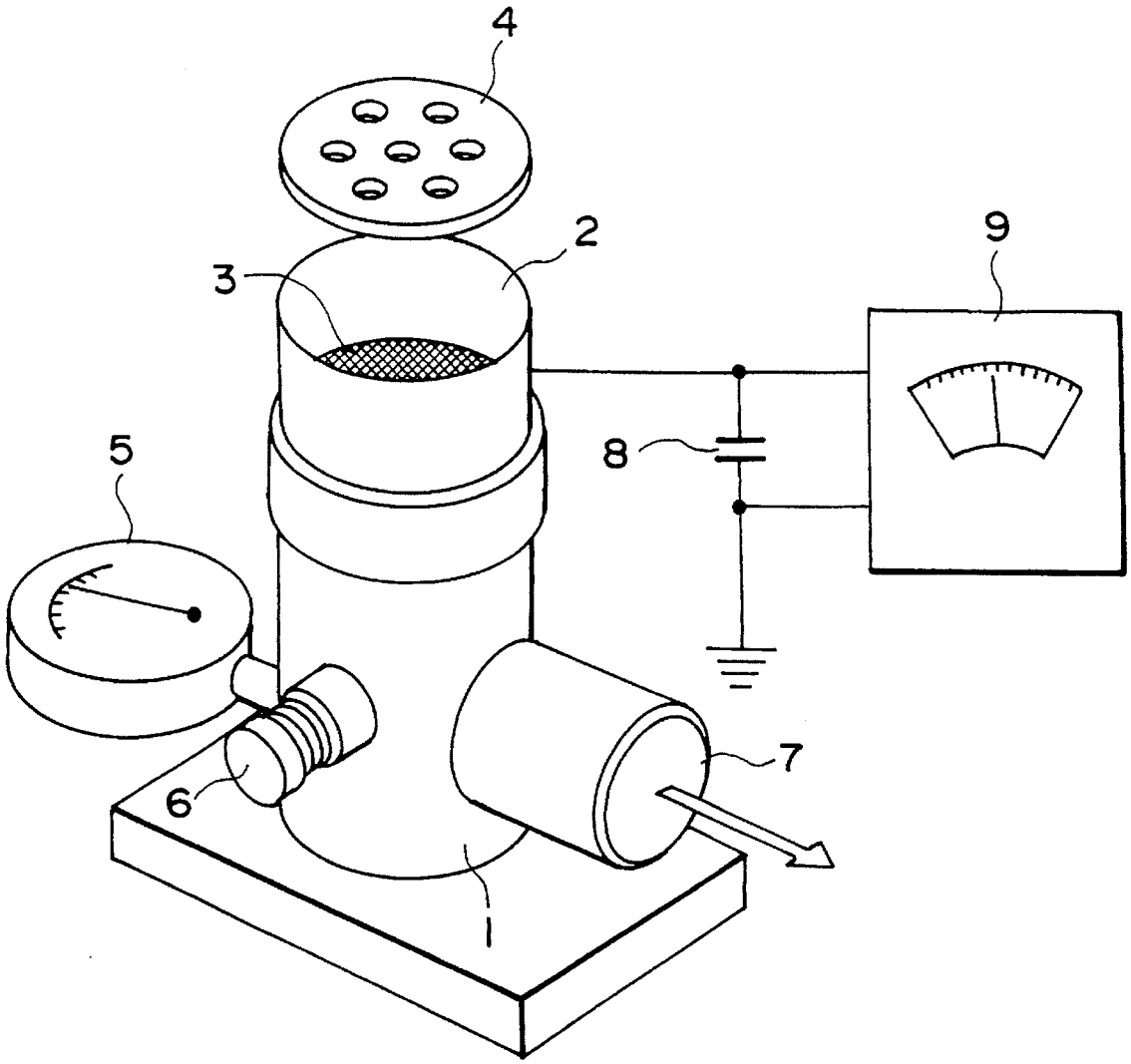
FIG. 6 is an illustration of an apparatus for measuring a triboelectric charge of a powdery sample.

The triboelectric charge may be measured by using an apparatus as shown in FIG. 6.

(i) Triboelectric charge of magnetic toner

Classified iron powder having a particle size between 200 mesh and 300 mesh and a magnetic toner are weighed in a weight ratio of 95:5, left standing for at least 12 hours in an environment for measurement of temperature 23° C. and humidity 60%, placed in a polyethylene vessel and sufficiently mixed under shaking.

Then, the shaken mixture is charged in a metal container 2 for measurement provided with 500-mesh screen 3 (the screen size being changed to an appropriate size not passing the magnetic powder) at the bottom as shown in FIG. 6 and covered with a metal lid 4. The total weight of the container 2 is weighed and denoted by $W_1$ (g). Then, an aspirator 1 composed of an insulating material at least with respect to a part contacting the container 2 is operated, and the toner in the container is removed by suction through a suction port 7 sufficiently (for about 2 min.) while controlling the pressure at a vacuum gauge 5 at 250 mmAq by adjusting an aspiration control valve 6. The reading at this time of a potential meter 9 connected to the container by the medium of a capacitor 8 having a capacitance C (μF) is denoted by V (volts.). The total weight of the container after the aspiration is measured and denoted by $W_2$ (g). Then, the triboelectric charge T (μC/g) is calculated as: $T\ (\mu C/g)=C\times V/(W_1-W_2)$.

(ii) Triboelectric charge of flowability-improving agent and organic fine powder The triboelectric charge may be measured in the same manner as in (i) except that the iron powder and flowability improving agent or organic fine powder are mixed in a weight ratio of 98:2.

(iii) Triboelectric charge of inorganic fine powder

In the magnetic toner production process, a kneaded product after solidification under cooling is crushed and classified to recover a kneaded coarse product having sizes between 200 mesh and 300 mesh. The kneaded coarse product and an inorganic fine powder sample are mixed in a weight ratio of 95:5 to obtain a measurement sample. Thereafter, the triboelectric charge measurement is affected in the same manner as in (i) except for using the measurement sample. The triboelectric charge is calculated as a volume-basis value (μC/cm$^3$) based on the density value.

Hereinbelow, the present invention will be described more specifically based on Production Examples and Example.

Production Example of strontium titanate 600 g of strontium carbonate and 320 g of titanium oxide were wet-blended for 8 hours in a ball mill, followed by filtration and drying. The mixture was molded under a pressure of 5 kg/cm$^2$ and calcined at 1100° C. for 8 hours.

Figure 4B:
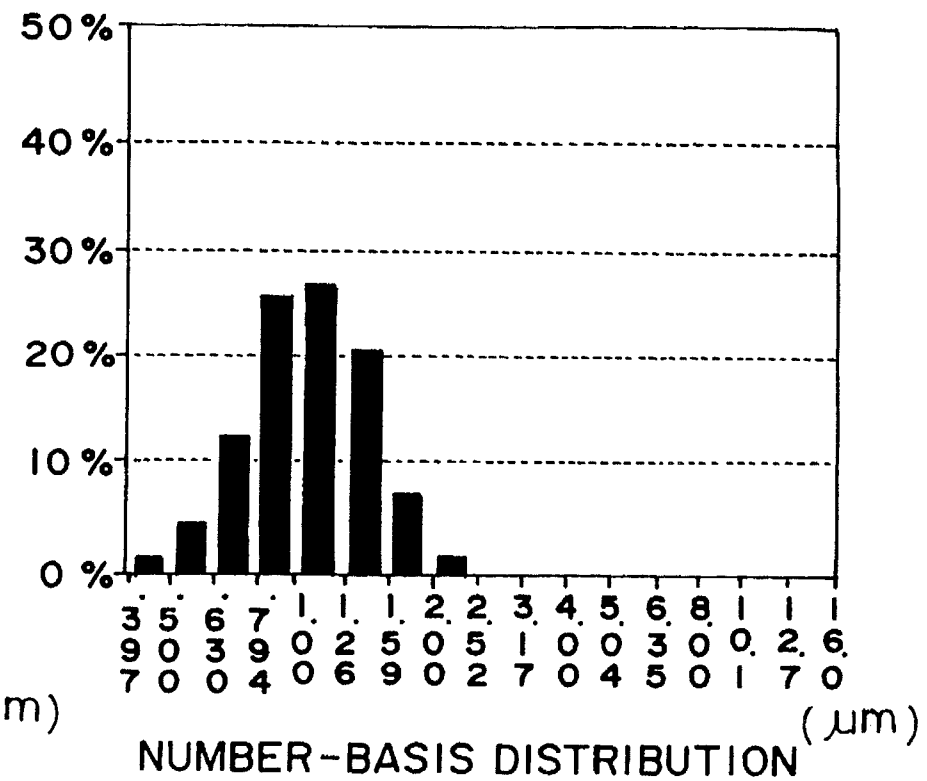
FIGS. 4(*a*) and 4(*b*) are volume-basis and number-basis particle size distribution of metal oxide powder as measured by a Coulter counter with a 13 μm-aperture.
Figure 4A:
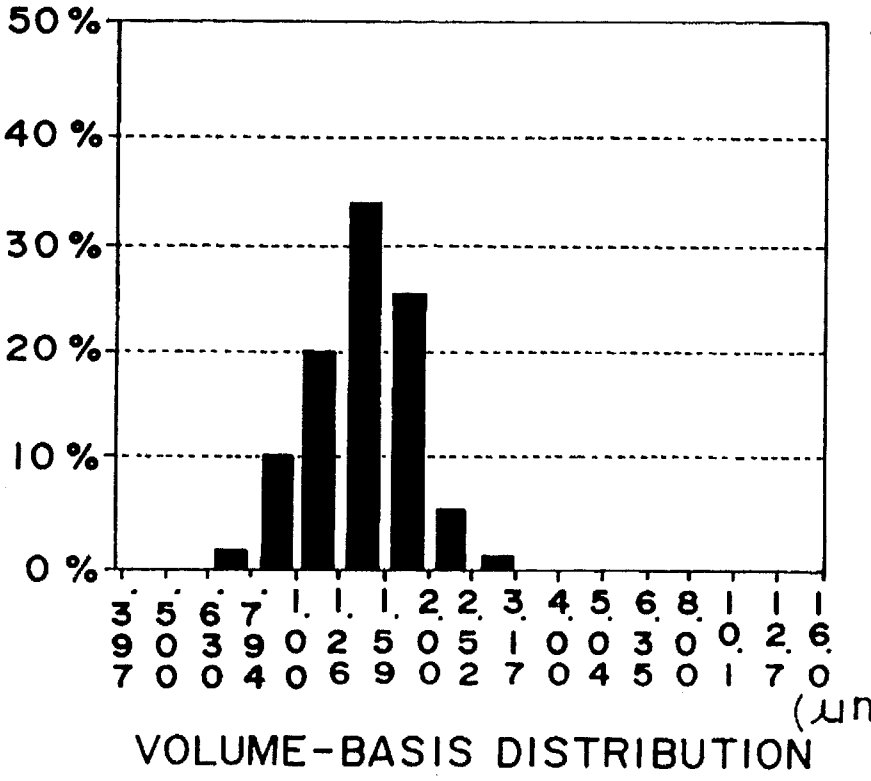
Figure 5B:
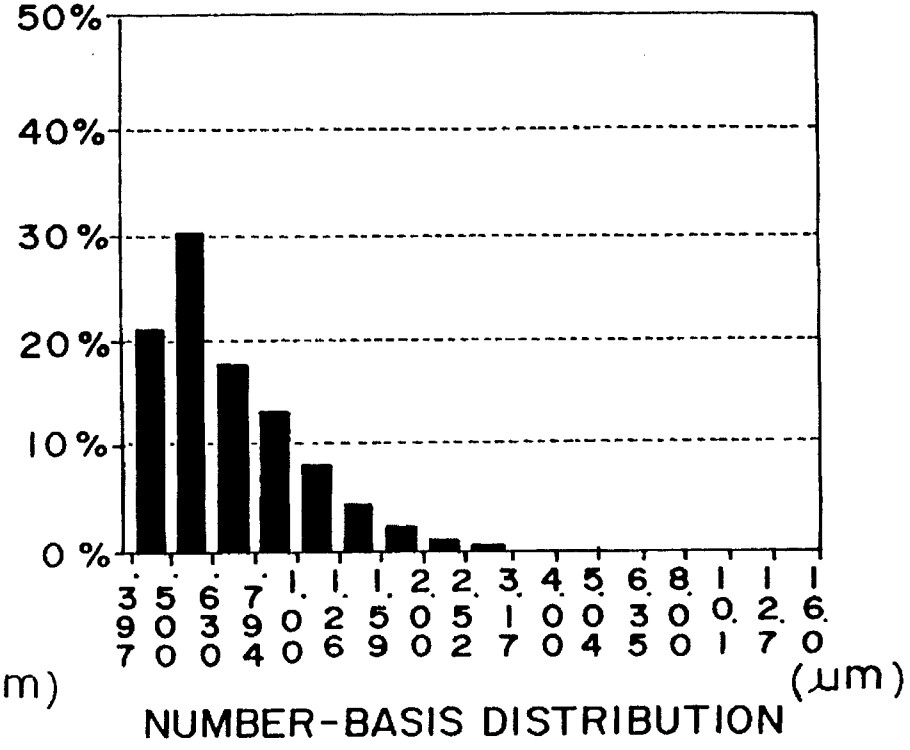
FIGS. 5(*a*) and 5(*b*) are volume-basis and number basis particle size distribution of metal oxide powder before classification as measured by a Coulter counter with a 13 μm-aperture.
Figure 5A:
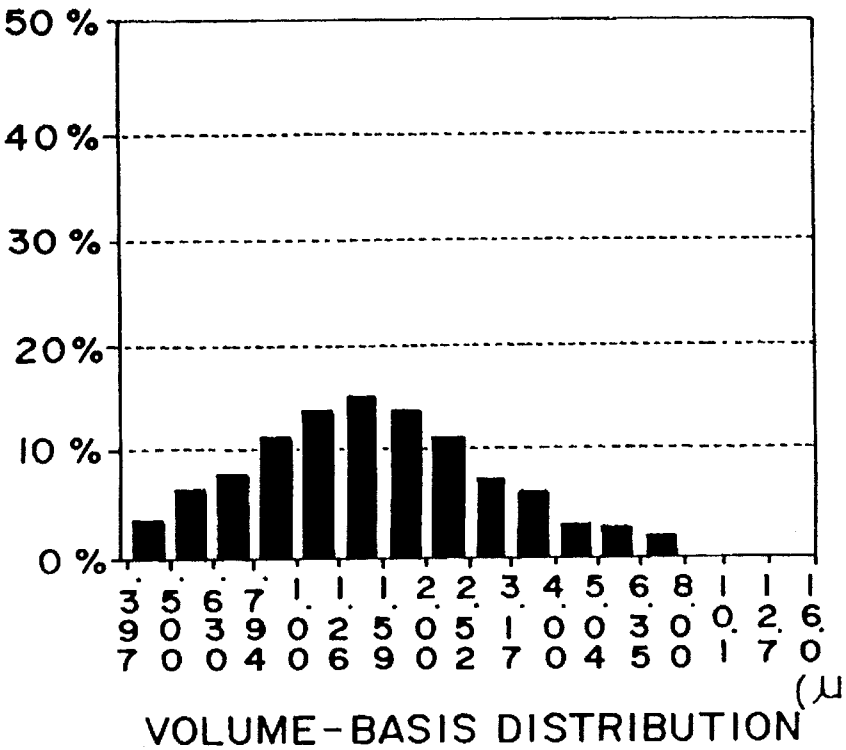

The calcined product is mechanically pulverized to obtain strontium titanate fine powder having a weight-average particle size ($m\text{-}D_4$) of 1.8 μm, a number-average particle size ($m\text{-}D_1$) of 0.7 μm, and a particle size distribution factor $[(m\text{-}D_4)/(m\text{-}D_1)]$ of 2.6. This is referred to as strontium titanate A, which showed a volume-basis particle size distribution and a number-basis particle size as shown in FIG. 5(*a*) and (*b*). The strontium titanate A was then introduced in an elbow jet classifier utilizing a Coanda effect to simultaneously remove Coarse powder and fine powder, thus recovering strontium titanate I having a weight-average particle size of 1.4 μm, a number-average particle size of 1.0 μm, and a particle size distribution factor $[(m\text{-}D_4)/(m\text{-}D_1)]$ of 1.4. The strontium titanate I showed a volume-basis particle size distribution and a number-basis particle size distribution as shown in FIG. 4(*a*) and (*b*), and a triboelectric charge of +4.5 μC/cm$^3$.

Similarly as above, strontium titanates II–V having various particle size distribution factors were obtained.

Production Example of aluminum oxide

Aluminum hydroxide was molded under a pressure of 1000 kg/cm$^2$ and sintered for 2 hours at 1600° C. The sintered product was mechanically pulverized and classified by the elbow jet classifier to obtain aluminum oxide I having a weight-average particle size of 4.0 μm, a number-average particle size of 2.5 μm and a particle size distribution factor $[(m\text{-}D_4)/(m\text{-}D_1)]$ of 1.6. The aluminum oxide I showed a triboelectric charge of +5.6 μC/cm$^3$.

Similarly as above, aluminum oxides II and III having different particle size distribution factors were obtained.

Production Example of zinc oxide

Zinc hydroxide was molded under a pressure of 100 kg/cm$^2$ and sintered for 5 hours at 500 ° C., followed by mechanical pulverization and pneumatic classification to obtain zinc oxide I having a weight-average particle size of 1.8 μm, a number-average particle size of 1.2 μm, and a particle size distribution factor $[(m\text{-}D_4)/(m\text{-}D_1)]$ of 1.5. The zinc oxide I showed a triboelectric charge of +20 μC/cm$^3$.

Production Example of calcium carbonate

Precipitate formed by blowing carbon dioxide into line milk was recovered by filtration, dried, pulverized and classified by the elbow jet classifier to recover calcium carbonate having a weight-average particle size of 3.5 μm, a number-average particle size of 1.7 μm, and a particle size distribution factor $[(m\text{-}D_4)/(m\text{-}D_1)]$ of 2.1. The calcium carbonate showed a triboelectric charge of +2.5 μC/cm$^3$.

Production Example of molybdenum trioxide

Ammonium molybdate was heated together with nitric acid to obtain molybdenum oxide, which was then recovered by filtration, washed with water, dried and calcined for 6 hours in air at 400° C. to obtain molybdenum trioxide powder. The molybdenum trioxide powder was then mechanically pulverized to obtain molybdenum trioxide fine powder having a weight-average particle size of 2.3 μm, a number-average particle size of 0.8 μm, and a particle size distribution factor $[(m\text{-}D_4)/(m\text{-}D_1)]$ of 2.9. The molybdenum trioxide powder was then classified by an elbow jet classifier to remove coarse powder and fine powder simultaneously to recover molybdenum trioxide Mo-I having a weight-average particle size of 1.8 μm, a number-average particle size of 1.0 μm, and a particle size distribution factor $[(m\text{-}D_4)/(m\text{-}D_1)]$ of 1.8.

The molybdenum trioxide Mo-I showed a triboelectric charge of −21 μC/cm$^3$.

Production Example of tungsten trioxide

Metallic tungsten was calcined for 10 hours in oxygen at 700° C. to obtain tungsten trioxide, which was then mechanically pulverized to obtain tungsten trioxide fine powder having a weight-average particle size of 4.0 μm, a number average particle size of 1.0 μm and a particle size distribution factor $[(m\text{-}D_4)/(m\text{-}D_1)]$ of 4.0. The tungsten trioxide fine powder was then classified by the elbow jet classifier to recover tungsten trioxide Wo-I having a weight-average particle size of 3.0 μm, a number-average particle size of 2.0 μm, and a particle size distribution factor $[(m\text{-}D_4)/(m\text{-}D_1)]$ of 1.5.

The tungsten trioxide Wo-I showed a triboelectric charge of −9 μC/cm$^3$.

Production Example of organic fine powder Production

Example 1 of positively chargeable organic fine powder

| | |
|---|---|
| Styrene | 75 wt. parts |
| Butyl acrylate | 10 wt. parts |
| Dimethylaminomethyl methacrylate | 15 wt. parts |
| Benzoyl peroxide | 3 wt. parts |

The above ingredients were dissolved in toluene and subjected to polymerization at 80° C. for 16 hours. After removing the toluene, the polymerization product was dried, pulverized and classified to obtain organic fine powder I having a number-average particle size (p-$D_1$) of 0.6 μm. The organic fine powder I showed a triboelectric charge of +70 μC/g.

Production Example 2 of positively chargeable organic fine powder

| | |
|---|---|
| Styrene | 90 wt. parts |
| n-Butyl acrylate | 10 wt. parts |
| Benzoyl peroxide | 4 wt. parts |

The above ingredients were dissolved in toluene and subjected to polymerization at 80° C. for 16 hours. After removal of the toluene, the product resin was dried. To 100 wt. parts of the resin, 10 wt. parts of a positive charge control agent of the above-described formula (A)-I was added, and the resultant mixture was kneaded at 130° C., cooled, pulverized and classified to obtain organic fine powder II having a number-average particle size (p-$D_1$) of 0.2 μm. The organic fine powder II showed a triboelectric charge of +35 μC/g.

Production Example 1 of negatively chargeable organic fine powder

| | |
|---|---|
| Styrene | 75 wt. parts |
| n-Butyl acrylate | 10 wt. parts |
| Monobutyl maleate | 15 wt. parts |
| Benzoyl peroxide | 4 wt. parts |

The above ingredients were dissolved in toluene and subjected to 16 hours of polymerization at 80° C. After removal of the toluene, the product resin was dried, pulverized and classified to recover organic fine powder III having a number-average particle size (p-$D_1$) of 0.7 μm. The organic fine powder showed a triboelectric charge of −50 μC/g.

Production Example 2 of negatively chargeable organic fine powder

A resin was prepared by polymerization in the same manner as in Production Example 1 of positively chargeable organic fine powder described above. To 100 wt. parts of the resin, 5 wt. parts of monoazo metal complex (a negative charge control agent) was added, and the resultant mixture was kneaded at 130° C., cooled, pulverized and classified to obtain organic fine powder IV having a number-average particle size (p-$D_1$) of 0.1 μm. The organic fine powder showed a triboelectric charge of −45 μC/g.

Production Example 1 of binder resin

| | |
|---|---|
| Styrene | 76.0 wt. parts |
| Butyl acrylate | 13.0 wt. parts |
| Monobutyl maleate | 11.0 wt. parts |
| Di-tert-butyl peroxide | 6.0 wt. parts |

The above ingredients were added dropwise in 4 hours to 200 wt. parts of xylene heated to the reflux temperature. Then, the polymerization was completed under xylene reflux (138°–144° C.), and the xylene was removed under a reduced pressure while raising the temperature up to 200° C. The thus-obtained resin is referred to as Resin A.

Resin A showed the following acidic value data.

TABLE 1

| (Resin A) | |
|---|---|
| Total acid value (A): | 48.0 |
| JIS acid value: | 31.0 |
| IR absorption peak at 1780 $cm^{-1}$: (showing the presence of acid anhydride group) | present |
| Resin A | 30.0 wt. part(s) |
| Styrene | 45.0 wt. part(s) |
| Butyl acrylate | 20.0 wt. part(s) |
| Monobutyl maleate | 5.0 wt. part(s) |
| Divinylbenzene | 0.5 wt. part(s) |
| Benzoyl peroxide | 1.5 wt. part(s) |

To the above mixture solution, 170 wt. parts of water containing 0.12 wt. part of partially saponified polyvinyl alcohol was added, followed by vigorous stirring to form a suspension liquid. In a reaction vessel containing 50 wt. parts of water and aerated with nitrogen, the above suspension liquid was added and subjected to suspension polymerization for 8 hours at 80° C. After completion of the reaction, the product was washed with water, de-watered and dried to obtain Resin B.

The thus-obtained Resin B was found to contain 73.3 mol. % of monobutyl maleate unit, 6.7 mol. % of maleic anhydride unit and 2 mol. % of maleic acid unit with respect to the total of these units assumed as 100 mol. %.

Resin B showed the following acidic value data:

TABLE 2

| (Resin B) | |
|---|---|
| Total acid value (A): | 23.0 |
| JIS acid value: | 21.0 |
| Total acid value (B): (attributable to acid anhydride group) | 4.0 |
| [(B)/(A)] × 100: | 13.0 |
| IR absorption peak at 1780 $cm^{-1}$: | present |

Resin B showed a glass transition temperature (Tg) of 59° C., a gel (THF-insoluble) content of 30 wt. %, a number-average molecular weight (Mn) of 12000 and a weight-average molecular weight (Mw) of 150,000. The gel content was measured by weighing 0.5–1.0 g of the resin, extracting the resin with THF by using a Soxhlet extractor for 6 hours, and weighing the dry weight of the insoluble. The molecular weights Mn and Mw were measured with respect to the THF-soluble matter (the total resin–the gel content).

Production Example 2 of binder resin

| | |
|---|---|
| Bisphenol deviative of Formula (A) (ethylene/propylene = 1/3 (wt.), x + y = about 5) | 1320 wt. parts |
| Fumaric acid | 100 wt. parts |
| Terephthalic acid | 200 wt. parts |
| Trimellitic acid | 300 wt. parts |

The above ingredients were placed in a 3 liter four-necked round-bottomed flask equipped with a thermometer, a stainless steel-made stirrer, a glass pipe for nitrogen introduction and a flowdown-type condenser. Then, the flask was placed in a mantle heater and heated to 220°–250° C. while introducing nitrogen from the glass pipe so as to maintain an inert atmosphere within the reaction vessel, whereby dehydrocondensation was effected at the temperature. When the content reached a prescribed viscosity based on a preliminarily obtained correlation between the viscosity and molecular weight, the product was cooled and solidified to obtain Resin C.

Resin C showed a Tg of 60° C., an Mn of 7,800 and an Mw of 22,000.

Production Example 3 of binder resin

| | |
|---|---|
| Styrene | 85.0 wt. parts |
| Butyl acrylate | 15.0 wt. parts |
| Di-tert-butyl peroxide | 6.0 wt. parts |

The above ingredients were added dropwise in 4 hours to 200 wt. parts of xylene heated to the reflux temperature. Then, the polymerization was completed under xylene reflux (138°–144° C.), and the xylene was removed under a reduced pressure while raising the temperature up to 200° C. to remove Resin D.

| | |
|---|---|
| Resin D | 40.0 wt. part(s) |
| Styrene | 45.0 wt. part(s) |
| Butyl acrylate | 15.0 wt. part(s) |
| Divinylbenzene | 0.5 wt. part(s) |
| Benzoyl peroxide | 1.5 wt. part(s) |

To the above mixture solution, 170 wt. parts of water containing 0.12 wt. part of partially saponified polyvinyl alcohol was added, followed by vigorous stirring to form a suspension liquid. In a reaction vessel containing 50 wt. parts of water and aerated with nitrogen, the above suspension liquid was added and subjected to suspension polymerization for 8 hours at 80° C. After completion of the reaction, the product was washed with water, de-watered and dried to obtain Resin E.

Resin E showed a glass transition temperature (Tg) of 61° C., a gel content of 27 wt. %, a number-average molecular weight (Mn) of 12000 and a weight-average molecular weight (Mw) of 100,000. The gel content and the molecular weights Mn and Mw were measured in the same manner as in Production Example 1 of binder resin described above.

Example 1

| | |
|---|---|
| Resin B (binder resin) | 100 wt. parts |
| Magnetic iron oxide (average particle size = 0.15 μm, Hc = 115 Oe, $\sigma_s$ = 80 emu/g, $\sigma_r$ = 11 emu/g) | 80 wt. parts |
| Low-molecular weight ethylene-propylene copolymer | 4 wt. parts |
| Monoazo metal complex (negative charge control agent) | 2 wt. parts |

Figure 3B:
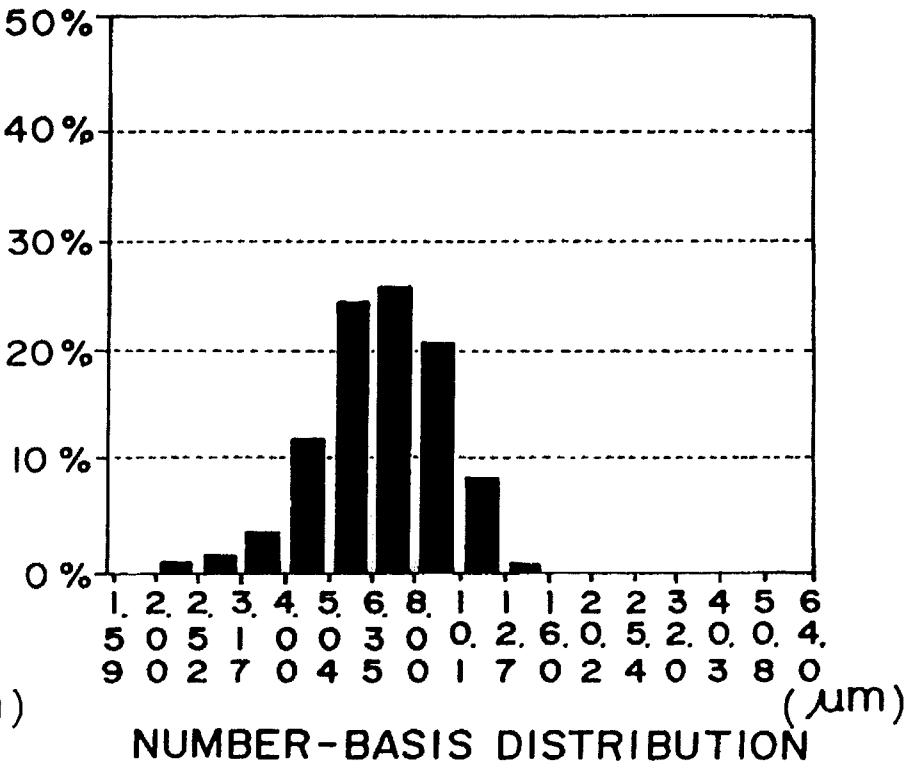
FIGS. 3(*a*) and 3(*b*) are graphs showing volume-basis and number-basis particle size distribution of an insulating magnetic toner as measured by a Coulter counter with a 100 μm-aperture.
Figure 3A:
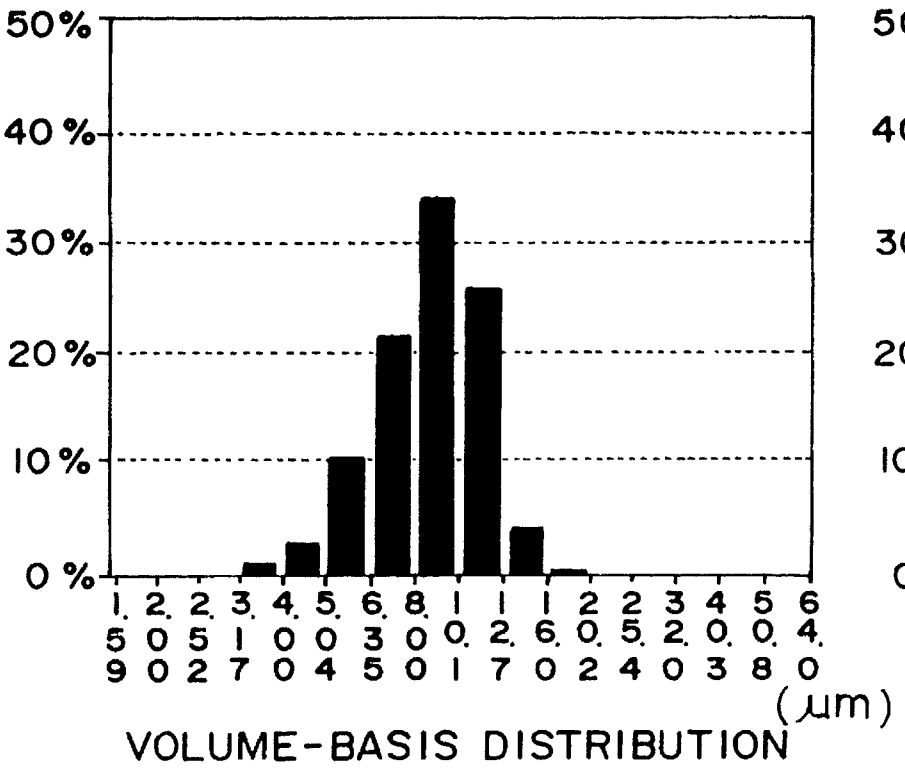

The above materials were pre-mixed by a Henschel mixer and melt-kneaded at 130° C. by a twin-screw extruder. After cooling, the kneaded product was coarsely crushed by a cutter mill and finely pulverized by a jet mill, followed by classification by a pneumatic classifier, to obtain black fine powder (negatively chargeable magnetic toner) having a weight-average particle size (t-$D_4$) of 9.0 μm, a number-average particle size (t-$D_1$) of 7.0 μm, a particle size distribution factor $[(t\text{-}D_4)/(t\text{-}D_1)]$ of 1.3 and a volume resistivity of at least $10^{14}$ ohm.cm. The magnetic toner showed a volume-basis and a number-basis particle size distribution as shown in FIG. 3(*a*) and (*b*), respectively.

To 100 wt. parts of the magnetic toner, 0.6 wt. part of hydrophobic dry-process silica (BET area of 150 $m^2/g$) and 3.0 wt. parts of strontium titanate I were externally added and mixed in a Henschel mixer to obtain a developer (A).

The developer (A) was evaluated for image formation in a laser copier obtained by remodeling a commercially available laser copier ("NP9330", mfd. by Canon K.K.) by replacing the photosensitive drum with an OPC photosensitive drum to form a reversal development system wherein the OPC photosensitive drum was negatively corona-charged and irradiated with a laser beam to form a latent image.

As a result, the resultant images were free from white-background fog, showed a maximum image density of 1.48 and showed a good density gradation characteristic even in a photographic image with characters, as represented by a relationship between image density and developing potential shown in FIG. 1.

Further, a copying test of 30,000 sheets was performed. As a result, the fixability was also good. The copied images showed good image qualities which were substantially unchanged from those obtained at the initial stage as described above. No damage was observed on the organic photosensitive member, and the photosensitive member showed an abraded photosensitive layer thickness of only 1.8 μm/10000 sheets as a result of measurement of the surface layer thickness based on eddy current. As a result of particle size distribution of the developer on the developer-carrying member after the copying test of 30,000 sheets, the developer showed a weight-average particle size of 9.6 μm and a number-average particle size of 7.3 μm which were not substantially different from the initial values of 9.0 μm and 6.8 μm, thus showing a good effect of suppressing the selective or preferential consumption for development. Further, the developing sleeve memory phenomenon was only slightly observed.

Further, copying tests were performed under low temperature—low humidity conditions (5° C., 10%) and also under high temperature—high humidity conditions (30° C., 80%), whereby good results were obtained similarly as under the normal temperature—normal humidity conditions. Under the high temperature—high humidity conditions, a long-term standing test was performed for 1 week, whereas good results were obtained without causing a density decrease after the standing test.

Example 2–7

Developers were prepared in the same manner as in Example 1 except that the compositions and toner particle sizes were modified as shown in Table 3. The developers were evaluated in the same manner as shown in Example 1, whereby good results were obtained as shown in Table 4 below.

The respective items were evaluated at 5 levels of o, oΔ, Δ, Δx and x from the best (o) to the worst (x). The same standards were used also for the subsequent Examples and Comparative Examples.

TABLE 3

Compositions and particle sizes of developers

| Example | Resin | M.I.O.*1 (wt. parts) | Wax*2 | MMC*3 (wt. parts) | Toner size t-$D_4$ | Toner size t-$D_1$ | Toner size (t-$D_4$)/(t-$D_1$) | Silica*4 (BET 150 $m^2/g$) | Inorganic fine powder*5 | m-$D_4$ | m-$D_1$ | (m-$D_4$)/(m-$D_1$) | Charge (μc/$cm^3$) | Developer size $D_4$ | Developer size $D_1$ |
|---|---|---|---|---|---|---|---|---|---|---|---|---|---|---|---|
| 1 | B | 80 | 4 | 2 | 9.0 | 7.0 | 1.3 | 0.6 | S.T. I 3 parts | 1.4 | 1.0 | 1.4 | +4.5 | 9.0 | 6.8 |
| 2 | B | 80 | 4 | 2 | 9.0 | 7.0 | 1.3 | 0.6 | S.T. II 4 parts | 1.7 | 1.1 | 1.6 | +4.3 | 9.0 | 6.8 |
| 3 | B | 80 | 4 | 2 | 9.0 | 7.0 | 1.3 | 0.6 | S.T. III 3 parts | 1.9 | 1.1 | 1.8 | +4.2 | 9.0 | 6.9 |
| 4 | B | 80 | 4 | 2 | 9.0 | 7.0 | 1.3 | 0.6 | A.O. I 3 parts | 4.0 | 2.5 | 1.6 | +5.6 | 9.1 | 6.8 |
| 5 | B | 100 | 3 | 1.5 | 7.2 | 5.1 | 1.4 | 0.6 | Z.O. I 4 parts | 1.8 | 1.2 | 1.5 | +20 | 7.2 | 5.0 |
| 6 | C | 80 | 4 | 2 | 10.0 | 7.0 | 1.4 | 0.5 | S.T. IV 3 parts | 1.9 | 1.1 | 1.7 | +4.8 | 10.0 | 7.0 |
| 7 | C | 100 | 3 | 1.5 | 7.0 | 5.2 | 1.3 | 0.6 | A.I. II 4 parts | 3.0 | 2.0 | 1.5 | +6.5 | 6.9 | 4.8 |

Remarks to Table 3
*1M.I.O. stand for magnetic iron oxide used in an amount of indicated wt. parts
*2Low-molecular weight ethylene-propylene copolymer used as a release agent in an amount of indicated wt. parts.
*3Monoazo metal complex used as a charge control agent in an amount of indicated wt. parts.
*4Hydrophobic silica having a BET specific area of 150 $m^2/g$ used in an amount of indicated wt. parts.
*5The following species of inorganic fine powder represented by the following abbreviations were used in an amount of indicated wt. parts.
S.T.: strontium titanate (I–IV)
A.O.: aluminum oxide (I–II)
Z.O.: zinc oxide (I)

TABLE 4

Evaluation of developer performances of Examples

| Example | Initial image*1 $D_{max}$ | Initial image*1 Fog | Initial image*1 Gradation | Continuous copying of 30000 sheets*2 $D_{max}$ | Continuous copying of 30000 sheets*2 Fog | Continuous copying of 30000 sheets*2 Gradation | Continuous copying of 30000 sheets*2 Fixability | Photosensitive member Damage | Photosensitive member Abration | Memory | Preferential consumption*3 Developer size on sleeve $D_4$ | Preferential consumption*3 Developer size on sleeve $D_1$ | *4 Environment | *5 Standing |
|---|---|---|---|---|---|---|---|---|---|---|---|---|---|---|
| 1 | 1.48 | o | o | 1.48 | o | o | o | none | 1.8 (μm) | o | o 9.6 (μm) | 7.3 (μm) | o | o |
| 2 | 1.47 | o | o | 1.47 | o | o | o | none | 2.0 | o | o 10.0 | 7.5 | o | o |
| 3 | 1.47 | o | o | 1.47 | o | o | o | none | 2.4 | o | o 9.9 | 7.6 | o | o |
| 4 | 1.45 | o | o | 1.43 | o | o | o | none | 2.0 | o | o 9.8 | 7.5 | o | o |
| 5 | 1.47 | o | o | 1.48 | o | o | o | none | 2.1 | o | o 7.4 | 5.2 | o | o |
| 6 | 1.50 | o | o | 1.48 | o | o | o | none | 2.0 | o | o 10.6 | 8.2 | o | o |
| 7 | 1.44 | o | o | 1.46 | o | o | o | none | 2.0 | o | o 7.2 | 5.0 | o | o |

Remarks to Table 4
*1Results of evaluation of copy image at the initial stage. Dmax stands for a maximum image density. Gradation stands for a density gradation characteristic.
*2Results of evaluation during or after a continuous copying test of 30000 sheets. Damage stands for surface damage on the photosensitive member. Abrasion stands for the abrasion loss of the surface layer expressed in thickness (μm) per 10000 sheets of copying. Memory stands for a developer-carrying member (sleeve) memory characteristic.
*3Preferential consumption of a particular size of developer after the continuous copying evaluated by comparison of the particle sizes $D_4$ and $D_1$ and ratio $D_4/D_1$ of the developer on the sleeve with the initial values of the developer used.
*4Environmental characteristic in terms of comparison of performances under low temperature - low humidity conditions and under high temperature - high humidity conditions with those under the normal temperature - normal humidity conditions.
*5Evaluation of performances after standing for 1 week under high temperature - high humidity conditions.

Comparative Examples 1–8

Developers were prepared in the same manner as in Example 1 except that the compositions and toner particle sizes were modified as shown in Table 5. The developers were evaluated in the same manner as in Example 1, whereby results as shown in Table 6 were obtained. The inorganic fine powder used in each Comparative Example was used after classification in a similar manner as in Examples.

TABLE 5

Compositions and particle sizes of developers

| Comp. Example | Resin | M.I.O*1 | Wax*2 | MMC*3 (wt. parts) | Toner size t-$D_4$ | Toner size t-$D_1$ | Toner size (t-$D_4$)/(t-$D_1$) | Silica*4 (BET 150 $m^2/g$) | Inorganic fine powder*5 | m-$D_4$ | m-$D_1$ | (m-$D_4$)/(m-$D_1$) | Charge (μc/g) | Developer size $D_4$ | Developer size $D_1$ |
|---|---|---|---|---|---|---|---|---|---|---|---|---|---|---|---|
| C.E. 1 | B | 80 | 4 | 2 | 9.0 | 7.0 | 1.3 | 0.5 | none | — | — | — | — | 9.0 | 6.9 |
| C.E. 2 | B | 80 | 4 | 2 | 9.0 | 7.0 | 1.3 | none | S.T. I 4 parts | 1.4 | 1.0 | 1.4 | +4.5 | 9.0 | 6.8 |
| C.E. 3 | B | 80 | 4 | 2 | 9.0 | 7.0 | 1.3 | 0.5 | S.T. A 4 parts | 1.8 | 0.7 | 2.6 | +4.8 | 9.0 | 6.9 |
| C.E. 4 | B | 80 | 4 | 2 | 9.0 | 7.0 | 1.3 | 0.5 | A.O. III 4 parts | 6.0 | 3.0 | 2.0 | +5.4 | 8.8 | 6.8 |
| C.E. 5 | B | 80 | 4 | 2 | 11.8 | 4.7 | 2.5 | 0.5 | S.T. I 4 parts | 1.4 | 1.0 | 1.4 | +4.5 | 12.7 | 5.8 |
| C.E. 6 | B | 80 | 4 | 2 | 12.7 | 9.7 | 1.3 | 0.5 | S.T. I 4 parts | 1.4 | 1.0 | 1.4 | +4.5 | 12.7 | 7.7 |
| C.E. 7 | B | 110 | 4 | 2 | 3.8 | 2.0 | 1.9 | 1.2 | S.T. V 8 parts | 2.4 | 1.2 | 2.0 | +4.0 | 3.7 | 1.7 |
| C.E. 8 | B | 80 | 4 | 2 | 9.0 | 7.0 | 1.3 | 0.5 | C.O. 4 parts | 4.8 | 1.0 | 4.8 | +8.5 | 8.9 | 6.8 |

Remarks to Table 5

Substantially the same remarks as applied to Table 3 are applicable except for the following:

*5The following species of inorganic fine powder represented by the following abbreviations were used in an amount of indicated wt. parts.

S.T.: strontium titanate (I, III, V, A)

A.O.: aluminum oxide (III)

C.O.: cerium oxide

TABLE 6

Evaluation of developer performances in Comparative Examples

| Comp. Ex. | Initial image*1 $D_{max}$ | Initial image*1 Fog | Initial image*1 Gradation | Continuous copying of 30000 sheets*2 $D_{max}$ | Continuous copying of 30000 sheets*2 Fog | Continuous copying of 30000 sheets*2 Gradation | Continuous copying of 30000 sheets*2 fixability | Photosensitive member Damage | Photosensitive member Abration | Memory | Preferential consumption*3 Developer size on sleeve $D_4$ | Preferential consumption*3 Developer size on sleeve $D_1$ |
|---|---|---|---|---|---|---|---|---|---|---|---|---|
| C.E. 1 | 1.30 | o | oΔ | 1.25 | o | Δx | o | none | 2.0 (μm) | Δx | x 12.8 (μm) | 9.8 (μm) |
| C.E. 2 | 0.90 | Δ | x **1 | 0.7 | x | x **1 | o | **1 | 4.2 | **1 | x 13.0 | 10.0 |
| C.E. 3 | 1.30 | oΔ | o | 1.26 | oΔ | o | o | none | 2.2 | Δ | Δ 12.6 | 9.7 |
| C.E. 4 | 1.35 | o | o | 1.10 | Δ | Δx **1 | o | **2 | 3.5 | Δ | Δx 11.5 | 9.3 |
| C.E. 5 | 1.35 | oΔ | oΔ | 1.25 | Δ | Δ | o | none | 2.0 | Δ | x 12.2 | 10.3 |
| C.E. 6 | 1.38 | o | oΔ | 1.35 | o | x | o | none | 2.1 | Δx | Δx 14.5 | 11.0 |
| C.E. 7 | 1.40 | x | oΔ | 1.20 | x | x | x | none | 4.0 | Δx | Δx 5.0 | 3.2 |
| C.E. 8 | 1.45 | o | Δx | 1.45 | o | Δx | o | none | 4.0 | Δx | Δ 11.0 | 9.0 |

| Comp. Ex. | Environment*4 | $D_{max}$ standing | Remark*6 |
|---|---|---|---|
| C.E. 1 | **1 | **1 0.8 | — |
| C.E. 2 | **1 | **1 0.5 | — |
| C.E. 3 | **1 | **2 0.2 | — |
| C.E. 4 | **1 | **2 0.8 | **1 |
| C.E. 5 | **1 | **2 1.15 | — |
| C.E. 6 | **1 | **2 1.15 | — |
| C.E. 7 | **2 | — | **2 |

TABLE 6-continued

| Evaluation of developer performances in Comparative Examples | | | | |
|---|---|---|---|---|
| | C.E. 8 | — | — | — |

Remarks to Table 6
Substantially the same remarks as applied to Table 4 are applicable except for the following.
Some additional notes are added regarding the following items.
*1[Gradation]
**1: Conspicuous roughening of the image.
*2[Gradation]
**1: Conspicuous roughening of the image.
*2[Damage]
**1: Extensive damage observed.
**2: Slight damage observed.
*2[Memory]
**1: Evaluation was impossible because of a low density.
*4[Environment]
**1: Low density under the high temperature - high humidity conditions.
**2: Low density under the low temperature - low humidity conditions.
*5[Standing]
**1: Remarkable lowering in density occurred.
**2: Lowering in density occurred.
*6[Remark] Additionally, the following difficulty was recognized.
**1: White streak occurred due to remaining metal oxide powder.
**2: Cleaning failure occurred.

Example 8

| | |
|---|---|
| Resin E (binder resin) | 100 wt. parts |
| Magnetic iron oxide (average particle size = 0.15 μm, Hc = 115 Oe, $\sigma_s$ = 80 emu/g, $\sigma_r$ = 11 emu/g) | 90 wt. parts |
| Low-molecular weight ethylene-propylene copolymer | 4 wt. parts |
| Monoazo metal complex (negative charge control agent) | 2 wt. parts |

The above materials were pre-mixed by a Henschel mixer and melt-kneaded at 130° C. by a twin-screw extruder. After cooling, the kneaded product was coarsely crushed by a cutter mill and finely pulverized by a jet mill, followed by classification by a pneumatic classifier, to obtain black fine powder (negatively chargeable magnetic toner) having a weight-average particle size (t-$D_4$) of 9.0 μm, a number-average particle size (t-$D_1$) of 7.0 μm, a particle size distribution factor $[(t\text{-}D_4)/(t\text{-}D_1)]_{of}$ 1.3 and a volume resistivity of at least $10^{14}$ ohm.cm. The magnetic toner showed a volume-basis and a number-basis particle size distribution as shown in FIG. 3(*a*) and (*b*), respectively.

To 100 wt. parts of the magnetic toner, 0.6 wt. part of hydrophobic dry-process silica (BET area of 150 $m^2/g$), 3.0 wt. parts of strontium titanate I and 0.3 wt. part of organic fine powder I were externally added and mixed in a Henschel mixer to obtain a developer.

The developer was evaluated for image formation in a laser copier obtained by remodeling a commercially available laser copier ("NP9330", mfd. by Canon K.K.) by replacing the photosensitive drum with an OPC photosensitive drum to form a reversal development system wherein the OPC photosensitive drum was negatively corona-charged and irradiated with a laser beam to form a latent image.

As a result, the resultant images were free from white-background fog, showed a maximum image density of 1.46 and showed a good density gradation characteristic even in a photographic image with characters, as represented by a relationship between image density and developing potential similar to that shown in FIG. 1. The edge effect was alleviated, and only slight change in density was observed in the vicinity of the edge of a solid image.

Further, a copying test of 30,000 sheets was performed. As a result, no toner scattering was observed and the fixability was also good. The copied images showed good image qualities which were substantially unchanged from those obtained at the initial stage as described above. No damage was observed on the organic photosensitive member, and the photosensitive member showed an abraded photosensitive layer thickness of only 1.6 μm/10000 sheets as a result of measurement of the surface layer thickness based on eddy current. As a result of particle size distribution of the developer on the developer-carrying member, the developer showed a weight-average particle size of 9.5 μm and a number-average particle size of 7.3 μm which were not substantially different from the initial values of 9.0 μm and 6.8 μm, thus showing a good effect of suppressing the selective or preferential consumption for development. Further, the developing sleeve memory phenomenon was only slightly observed.

Further, copying tests were performed under low temperature—low humidity conditions (5° C., 10%) and also under high temperature—high humidity conditions (30° C., 80%), whereby good results were obtained similarly as under the normal temperature—normal humidity conditions. Under the high temperature—high humidity conditions, a long-term standing test was performed for 1 week, whereas good results were obtained without causing a density decrease after the standing test.

Example 9 and 10

Developers were prepared in the same manner as in Example 8 except that the compositions and toner particle sizes were modified as shown in Table 7. The developers were evaluated in the same manner as shown in Example 8, whereby good results were obtained as shown in Table 8 below.

TABLE 7

| Compositions and particle sizes of developers | | | | | | | | | | | | | | | | |
|---|---|---|---|---|---|---|---|---|---|---|---|---|---|---|---|---|
| | | MIO*1 | Wax*2 | MMC*3 | Toner size | | | Silica*4 (BET | Inorganic fine powder*5 | | | | OFP*6 | | Developer size | |
| Example | Resin | (wt. parts) | (wt. parts) | (wt. parts) | $t\text{-}D_4$ | $t\text{-}D_1$ | $(t\text{-}D_4)/(t\text{-}D_1)$ | 150 $m^2/g$) | | $m\text{-}D_4$ | $m\text{-}D_1$ | $(m\text{-}D_4)/(m\text{-}D_1)$ | | $p\text{-}D_4$ | $D_4$ | $D_1$ |
| 8 | E | 90 | 4 | 2 | 9.0 | 7.0 | 1.3 | 0.6 | S.T. I 3 parts | 1.4 | 1.0 | 1.4 | I 0.3 | 0.6 | 9.0 | 6.8 |
| 9 | E | 90 | 4 | 2 | 9.0 | 7.0 | 1.3 | 0.6 | A.O. I 3 parts | 4.0 | 2.5 | 1.6 | II 0.3 | 0.2 | 8.9 | 6.9 |
| 10 | C | 90 | 4 | 2 | 8.5 | 6.5 | 1.3 | 0.6 | C.C. 3 parts | 3.5 | 1.7 | 2.1 | II 0.3 | 0.2 | 8.4 | 6.2 |

Remarks to Table 7
Substantially the same remarks as applied to Table 3 are applicable except for the following:
*5The following species of inorganic fine powder represented by the following abbreviations were used in an amount of indicated wt. parts.
S.T.: strontium titanate (I)
A.O.: aluminum oxide
C.C.: calcium carbonate
*6OFP stands for organic fine powder I, II or III used in an amount of indicated wt. parts.

TABLE 8

| Evaluation of developer performances in Examples | | | | | | | | | | | | |
|---|---|---|---|---|---|---|---|---|---|---|---|---|
| | | | | | Continuous copying of 30000 sheets*2 | | | | | | | |
| | Initial image*1 | | | Edge | | | | | | Photosensitive member | | |
| Ex. | $D_{max}$ | Fog | Gradation | character | $D_{max}$ | Fog | Gradation | Fixability | Scattering | Damage | Abration | Memory |
| 8 | 1.46 | o | o | o | 1.46 | o | o | o | o | none | 1.6 (μm) | o |
| 9 | 1.45 | o | o | o | 1.45 | o | o | o | o | none | 1.7 | o |
| 10 | 1.47 | o | o | o | 1.46 | o | o | o | o | none | 1.7 | o |

| | Preferential consumption*3 | | | | |
|---|---|---|---|---|---|
| | | Developer size on sleeve | | *4 | *5 |
| Ex. | | $D_4$ | $D_1$ | Environment | Standing |
| 8 | o | 9.5 | 7.3 | o | o |
| 9 | o | 9.4 | 7.2 | o | o |
| 10 | o | 8.9 | 6.7 | o | o |

Remarks to Table 8
The same remarks as applied to Table 4 are applicable except that the edge character (density change near the edge of a solid image) and the toner scattering were also evaluated.

Example 11

A positively chargeable magnetic toner was obtained in the same manner as in Example 8 except that the monoazo metal complex (negative charge control agent) was replaced by 2 wt. parts of nigrosine (positive charge control agent). The magnetic toner showed a weight-average particle size ($t\text{-}D_4$) of 9.0 μm, a number-average particle size ($t\text{-}D_1$) of 7.0 μm, and a distribution factor $[(t\text{-}D_4)/(t\text{-}D_1)]$ of 1.3.

100 wt. parts of the positively chargeable magnetic toner was blended with 0.5 wt. part of treated silica (obtained by treating colloidal silica (Aerosil 130 (trade name)) with 13 wt. % of amino group-containing silicone oil (KF857 (trade name)) and showing a BET specific surface area of 120 $m^2/g$ and a triboelectric charge of +120 μC/g), 3.0 wt. parts of molybdenum trioxide Mo-I and 0.3 wt. part of organic fine powder III, externally added thereto, by means of a Henschel mixer to obtain a developer.

The developer was evaluated for image formation in a copying machine obtained by re-modeling a commercially available copier ("NP 4835", mfd. by Canon K.K.) by replacing the transfer unit with a roller transfer unit.

As a result, the resultant images were free from white-background fog, showed a maximum image density of 1.45 and showed a good density gradation characteristic even in a photographic image with characters, as represented by a relationship between image density and developing potential similar to that shown in FIG. 1.

The edge effect was alleviated, and only slight change in density was observed in the vicinity of the edge of a solid image. No white dropout (hollow image formation) due to transfer failure was observed either.

Further, a copying test of 30,000 sheets was performed. As a result, no toner scattering was observe and the fixability was also good. The copied images showed good image qualities which were substantially unchanged from those obtained at the initial stage as described above. No damage was observed on the organic photosensitive member, and the photosensitive member showed an abraded photosensitive layer thickness of only 1.8 μm/10000 sheets as a result of measurement of the surface layer thickness based on eddy current. As a result of particle size distribution of the developer on the developer-carrying member, the developer showed a weight-average particle size of 9.6 μm and a number-average particle size of 7.8 μm which were not substantially different from the initial values of 9.0 μm and 7.0 μm, thus showing a good effect of suppressing the selective or preferential consumption for development. Further, the developing sleeve memory phenomenon was only slightly observed.

Further, copying tests were performed under low temperature—low humidity conditions (5° C., 10%) and also under high temperature—high humidity conditions (30° C., 80%), whereby good results were obtained similarly as under the normal temperature—normal humidity conditions. Under the high temperature—high humidity conditions, a long-term standing test was performed for 1 week, whereas good results were obtained without causing a density decrease after the standing test.

Example 12

A developer was prepared in the same manner as in Example 11 except that the molybdenum trioxide and the organic fine powder III were replaced by the same amounts of tungsten trioxide and organic fine powder IV, respectively. The developer thus obtained showed a weight-average particle size of 9.0 μm and a number-average particle size of 6.9 μm.

The developer was evaluated in the same manner as in Example 11, whereby good results as shown in Table 9 were obtained.

TABLE 9

Evaluation results of Examples 11 and 12

| | Initial image*1 | | | Edge | Transfer | Continuous copying of 30000 sheets*2 | | | | | | | |
|---|---|---|---|---|---|---|---|---|---|---|---|---|---|
| | | | | | | | | | | | Photosensitive member | | |
| Ex. | $D_{max}$ | Fog | Gradation | character | dropout | $D_{max}$ | Fog | Gradation | Fixability | Scattering | Damage | Abration | Memory |
| 11 | 1.45 | o | o | o | o | 1.45 | o | o | o | o | none | 1.8 (μm) | o |
| 12 | 1.47 | o | o | o | o | 1.47 | o | o | o | o | none | 1.9 | o |

| | Preferential consumption*3 | | | |
|---|---|---|---|---|
| | Developer size on sleeve | | *4 | *5 |
| Ex. | $D_4$ | $D_1$ | Environment | Standing |
| 11 | 9.6 | 7.8 | o | o |
| 12 | 9.7 | 8.0 | o | o |

Remarks to Table 9
The same remarks as applied to Table 4 are applicable except that the edge character (density change near the edge of a solid image), the transfer dropout (hollow image formation due to transfer failure) and the toner scattering were also evaluated.

As described above, the developer for developing electrostatic images according to the present invention is excellent in developing performances, particularly in effect of suppressing selective or preferential consumption for development of a particular particle size range which causes a change in particle size distribution and thus a change in developing performance during a long term of continuous image forming operation. Further, the developer is also effective in developing latent images formed on an OPC photosensitive member comprising an organic photoconductive substance.

What is claimed is:

1. A one-component developer for developing an electrostatic image, comprising:

an insulating, negatively chargeable magnetic black toner containing a binder resin, a magnetic material and a negative charge control agent, and having a weight-average particle size ($t\text{-}D_4$) of 4–12 μm, a number-average particle size ($t\text{-}D_1$) of 1–10 μm and a ratio $(t\text{-}D_4)/(t\text{-}D_1)$ of 1.01–2, wherein the magnetic material is contained in a proportion of 20–150 wt. parts per 100 wt. parts of the binder resin, a flowability-improving agent having a BET specific surface area of at least 30 $m^2/g$, and positively chargeable inorganic fine powder having a weight-average particle size ($m\text{-}D_4$) of 0.6–5 μm, a number-average particle size ($m\text{-}D_1$) of 0.5–4 μm, and a ratio $(m\text{-}D_4)/(m\text{-}D_1)$ which is in the range of 1.1–2.4 and is equal to or larger than the ratio $(t\text{-}D_4)/(t\text{-}D_1)$, wherein the inorganic fine powder is contained in an amount which is 2–8 times that of the flowability-improving agent by weight, and the insulating magnetic toner and the inorganic fine powder have particle sizes satisfying the following condition:

$$1.5 \leqq (t\text{-}D_4)/(m\text{-}D_4) \leqq 7.0.$$

2. The developer according to claim 1, wherein the inorganic fine powder comprises fine powder of a metal oxide.

3. The developer according to claim 1, further containing organic fine powder which is chargeable to a polarity opposite to that of the insulating magnetic toner and has a number-average particle size ($p\text{-}D_1$) of at most 0.8 μm.

4. The developer according to claim 1, wherein the insulating magnetic toner and the inorganic fine powder have particle sizes satisfying the following condition:

$$1.0 \leqq [(m\text{-}D_4)/(m\text{-}D_1)]/[(t\text{-}D_4)/(t\text{-}D_1)] \leqq 2.3.$$

5. The developer according to claim 1, wherein the binder resin comprises a vinyl resin having a total acid value (A) of 2–100 mgKOH/g.

6. The developer according to claim 5, wherein the binder resin comprises a vinyl resin having a total acid value (B) attributable to acid anhydride group of at most 6 mgKOH/g.

7. The developer according to claim 1, wherein the binder resin comprises a vinyl resin having a total acid value (A) of 5–70 mgKOH/g.

8. The developer according to claim 1, wherein the binder resin comprises a vinyl resin having a total acid value (A) of 5–50 mgKOH/g.

9. The developer according to claim 1, wherein the binder resin has a glass transition temperature of 45°–80° C., a number-average molecular weight of 2,500–50,000, and a weight-average molecular weight of 10,000–1,000,000.

10. The developer according to claim 1, wherein the binder resin comprises a polyester resin.

11. The developer according to claim 10, wherein the polyester resin has an acid value of at most 90 and an OH value of at most 50.

12. The developer according to claim 10, wherein the polyester resin has an acid value of at most 50 and an OH value of at most 30.

13. The developer according to claim 10, wherein the polyester resin has a glass transition temperature of 50°–75° C., a number-average molecular weight of 1,500–50,000, and a weight-average molecular weight of 6,000–100,000.

14. The developer according to claim 10, wherein the binder resin has a glass transition temperature of 55°–65° C., a number-average molecular weight of 2,000–20,000, and a weight-average molecular weight of 10,000–90,000.

15. The developer according to claim 1, wherein the charge control agent is contained in an amount of 0.1–10 wt. parts per 100 wt. parts of the binder resin.

16. The developer according to claim 1, wherein the charge control agent is contained in an amount of 0.1–5 wt. parts per 100 wt. parts of the binder resin.

17. The developer according to claim 1, wherein the magnetic material has an average particle size of 0.1–2 μm and magnetic properties including a coercive force of 20–150 Oersted, a saturation magnetization of 50–200 emu/g and a residual magnetization of 2–20 emu/g on application of 10 kilo-Oersted.

18. The developer according to claim 17, wherein the magnetic material has a saturation magnetization of 50–100 emu/g.

19. The developer according to claim 1, wherein the flowability-improving agent comprises silica fine powder having a BET specific surface area of at least 50 $m^2/g$.

20. The developer according to claim 19, wherein the silica fine powder is imparted with hydrophobicity.

21. The developer according to claim 1, wherein the inorganic fine powder comprises a metal oxide selected from the group consisting of magnesium oxide, zinc oxide, aluminum oxide, cobalt oxide, iron oxide, zirconium oxide, manganese oxide, chromium oxide, strontium oxide, calcium titanate, magnesium titanate, strontium titanate, and barium titanate.

22. The developer according to claim 1, wherein the flowability-improving agent comprises hydrophobic silica, and the inorganic fine powder comprises strontium titanate.

* * * * *